US007380685B2

(12) United States Patent
Simmons et al.

(10) Patent No.: US 7,380,685 B2
(45) Date of Patent: Jun. 3, 2008

(54) CONTAINERS, SLEEVES AND LIDS THEREFOR, ASSEMBLIES THEREOF, AND HOLDING STRUCTURE THEREFOR

(76) Inventors: Michael J. Simmons, 5650 N. Smith Rd., Henderson, MI (US) 48841; Jack Simmons, 15010 Frost Rd., Hemlock, MI (US) 48626; John M. Simmons, 5650 N. Smith Rd., Henderson, MI (US) 48841; Tom M. Simmons, 3670 Raucholz Rd., Hemlock, MI (US) 48626; David M. Simmons, 8873 W. Brookshire Dr., Saginaw, MI (US) 48609

( * ) Notice: Subject to any disclaimer, the term of this patent is extended or adjusted under 35 U.S.C. 154(b) by 493 days.

(21) Appl. No.: 10/783,981

(22) Filed: Feb. 19, 2004

(65) Prior Publication Data

US 2005/0184074 A1 Aug. 25, 2005

(51) Int. Cl.
*A47G 19/22* (2006.01)

(52) U.S. Cl. ..... 220/703; 220/380; 220/592.17; 220/781; 220/4.26; 206/508; 206/515; 206/503

(58) Field of Classification Search ..... 206/508, 206/515, 503, 505, 509; 220/740, 781, 380, 220/903, 275, 701, 4.03, 4.26, 4.27
See application file for complete search history.

(56) References Cited

U.S. PATENT DOCUMENTS 2,061,496 A 11/1936 Wright
2,429,958 A 10/1947 Liebmann
2,493,633 A * 1/1950 Mart ..... 206/519
2,658,253 A * 11/1953 Richardson ..... 27/35
2,661,889 A 12/1953 Phinney
2,915,176 A 12/1959 O'Neil
2,929,526 A * 3/1960 Steinberg ..... 215/393
3,079,027 A 2/1963 Edwards
3,246,786 A * 4/1966 Holley ..... 215/393
3,257,025 A * 6/1966 Jolly ..... 220/739
3,307,739 A 3/1967 Cloyd et al.
3,337,109 A * 8/1967 Shumrak ..... 220/738
3,372,830 A 3/1968 Edwards
3,384,265 A 5/1968 Frank
3,443,715 A 5/1969 Edwards
3,580,468 A 5/1971 McDevitt
3,598,271 A 8/1971 Holley
3,612,346 A 10/1971 Schneider
3,804,281 A 4/1974 Eckdahl (Continued)

*Primary Examiner*—Anthony Stashick
*Assistant Examiner*—Christopher McKinley
(74) *Attorney, Agent, or Firm*—TraskBritt

(57) ABSTRACT

Containers, lids, and sleeve structures are disclosed. Particularly, sleeve structures configured for insulating, stabilizing, or both insulating and stabilizing a container are disclosed. Further, a sleeve structure including a plurality of circumferentially adjacent, longitudinally extending sections and a sleeve structure including one or more frustoconical regions are disclosed. Containers, lids, and sleeve structures including at least one stabilizing feature are disclosed. Assemblies including a lower container, associated lid and sleeve structure, wherein at least one of the lower container, the lid, or the sleeve structure includes at least one stabilizing feature for engaging at least a portion of a sleeve structure associated with an upper container, wherein the upper container is positioned longitudinally above and is substantially aligned or centered with respect to a lower container, are disclosed. Circumferentially separated stabilizing features, individually installable stabilizing features, integral stabilizing features, and removable stabilizing features are also disclosed.

55 Claims, 18 Drawing Sheets

U.S. PATENT DOCUMENTS 3,815,281 A * 6/1974 Kander ..... 446/77
RE28,797 E * 5/1976 Brewer ..... 220/781
3,954,178 A * 5/1976 Mason, Jr. ..... 206/508
3,973,693 A 8/1976 Brocklehurst
4,040,537 A 8/1977 Edwards
4,051,951 A 10/1977 Smith
4,089,498 A * 5/1978 Woodruff ..... 248/346.11
4,163,374 A * 8/1979 Moore et al. ..... 62/457.4
4,359,076 A * 11/1982 Kyte ..... 141/391
4,363,404 A * 12/1982 Westphal ..... 206/508
4,402,451 A * 9/1983 Woerz et al. ..... 229/5.5
4,412,644 A 11/1983 La Fever
4,421,244 A * 12/1983 Van Melle ..... 220/781
4,485,923 A * 12/1984 Schwaikert ..... 206/508
4,548,348 A 10/1985 Clements
4,548,349 A 10/1985 Tunberg
4,610,351 A 9/1986 Coles et al.
4,615,459 A * 10/1986 Clements ..... 220/254.3
4,632,272 A * 12/1986 Berenfield et al. ..... 220/324
4,726,553 A 2/1988 Wischusen, III
4,747,507 A 5/1988 Fitzgerald et al.
4,762,248 A * 8/1988 Uhlig ..... 206/508
4,785,992 A * 11/1988 Goeppner ..... 229/5.6
4,832,212 A 5/1989 Askinazi
4,850,496 A * 7/1989 Rudell et al. ..... 215/12.1
4,865,199 A 9/1989 Zimmer
4,867,313 A 9/1989 Padovani
4,892,215 A * 1/1990 Carlson et al. ..... 220/610
4,928,848 A 5/1990 Ballway
4,928,876 A 5/1990 Marshall
4,978,024 A * 12/1990 Newman et al. ..... 220/713
5,025,981 A * 6/1991 Schellenberg ..... 229/118
5,040,719 A 8/1991 Ballway
5,143,247 A * 9/1992 Gavle ..... 220/630
5,205,473 A 4/1993 Coffin, Sr.
5,307,250 A * 4/1994 Pearson ..... 362/101
5,326,019 A 7/1994 Wolff
5,348,181 A * 9/1994 Smith et al. ..... 220/254.3
5,385,255 A * 1/1995 Varano et al. ..... 229/404
5,385,260 A 1/1995 Gatcomb
5,627,150 A * 5/1997 Peterson et al. ..... 510/439
5,752,653 A 5/1998 Razzaghi
5,820,016 A 10/1998 Stropkay
5,954,217 A * 9/1999 Brkovic et al. ..... 220/62.13
5,996,837 A * 12/1999 Freek et al. ..... 220/713
6,047,852 A * 4/2000 Evans et al. ..... 220/793
6,056,145 A * 5/2000 Rush et al. ..... 220/297
D426,367 S * 6/2000 Gale ..... D1/105
6,070,755 A * 6/2000 Evans et al. ..... 220/793
6,126,035 A * 10/2000 Schaper et al. ..... 220/771
6,247,608 B1 * 6/2001 Chang et al. ..... 220/269
6,250,494 B1 * 6/2001 Diamond ..... 220/783
6,305,817 B1 * 10/2001 Johnston et al. ..... 362/154
6,325,213 B1 * 12/2001 Landis, II ..... 206/519
6,364,151 B1 * 4/2002 Gale ..... 220/738
6,419,112 B1 * 7/2002 Bruce et al. ..... 220/781
6,562,270 B1 * 5/2003 Gannon et al. ..... 264/239
6,571,976 B1 * 6/2003 Sonnabend ..... 220/483
6,708,835 B1 * 3/2004 Mathis ..... 220/4.03
6,880,715 B2 * 4/2005 Tanabe et al. ..... 220/23.86
6,883,677 B2 * 4/2005 Goeking et al. ..... 220/713
D524,117 S * 7/2006 Goodman et al. ..... D7/619.1
2002/0020708 A1 * 2/2002 Weiss et al. ..... 220/366.1
2003/0089713 A1 * 5/2003 Belt et al. ..... 220/253
2004/0007573 A1 * 1/2004 Kang ..... 220/4.27
2004/0084346 A1 * 5/2004 Candy ..... 206/505
2004/0232154 A1 * 11/2004 Smith et al. ..... 220/713
2004/0251262 A1 * 12/2004 Hechmati ..... 220/739
2005/0155973 A1 * 7/2005 Goeking et al. ..... 220/717
2005/0184074 A1 * 8/2005 Simmons et al. ..... 220/592.17
2005/0211713 A1 * 9/2005 Goeking et al. ..... 220/713
2006/0075770 A1 * 4/2006 Lefkowitz et al. ..... 62/457.4

* cited by examiner

CONTAINERS, SLEEVES AND LIDS THEREFOR, ASSEMBLIES THEREOF, AND HOLDING STRUCTURE THEREFOR

BACKGROUND OF THE INVENTION

1. Field of the Invention

The present invention relates generally to containers. For instance, the present invention relates to insulated cups for holding hot or cold beverages.

2. State of the Art

Containers, such as cups for holding liquids or other materials, have been prevalently used for many years. Particularly, disposable cups and containers are used throughout the food industry, homes, offices, work sites, the transportation industry, and in many other circumstances and environments. Disposable cups and containers are generally made of foam, paper, or plastic.

In general, cups for use as personal beverage carriers generally exhibit a "frustoconical" configuration consisting of a closed circular base, a conical wall that extends upward and tapers radially outward from the outer perimeter of the base, and an open, circular mouth or rim. Because frustoconical cups are wider at the top than at the bottom, they may be top-heavy and, therefore, may not be resistant to tipping when filled.

Cup or container instability may be of considerable concern in many environments, for instance, such as on trains, airplanes, or motor vehicles, where bumps may cause frustoconically shaped cups to tip and the contents to spill out. Instability may be of greater concern when serving hot liquids, and particularly, when very hot liquids are disposed within frustoconically shaped disposable cups.

In order to compensate for this instability and consequent risk, cups have been designed with wide bottoms and narrow tops. While these designs make the filled container bottom heavy, and stable, such products have very limited commercial feasibility, and are not practicable in the context of disposable cups and containers for the simple reason that they cannot be efficiently stacked for packing, shipping and storage. U.S. Pat. No. 4,412,644 to La Fever discloses a spill-resistant disposable paper cup having a wide bottom and narrow top, but requires that a lid or covering be adhesively affixed to the bottom opening.

Furthermore, insulating a beverage or food, either hot or cold, is generally a preferable characteristic for a cup or container. Some of the materials used to make conventional cups and containers, like polystyrene, are relatively good insulators. In contrast, plastic and paper may be relatively poor insulators, making them unsuitable for holding very hot or very cold liquids. However, even polystyrene cups, if thin-walled, may be unsuitable or uncomfortable when holding very hot liquids or may be structurally inadequate. Also, polystyrene is not easily recycled and is not biodegradable.

Cup liners, sleeves, and cup holders, which fit against and surround the outside wall of cups to better insulate paper and plastic cups and thin-walled foam cups or at least prevent burning of hands holding such cups, are well known and commercially available. For instance, U.S. Pat. No. 5,205,473 to Coffin, Sr. discloses a corrugated beverage holder sleeve that fits about a cup to provide insulation from the contents thereof.

Other cup and container configurations have provided a double wall for insulation or stability for use with a cup or container. U.S. Pat. No. 4,548,348 to Clements discloses an expanded base for preventing the spilling of a cup, as does U.S. Pat. No. 4,865,199 to Zimmer and U.S. Pat. No. 5,143,247 to Gavle. U.S. Pat. No. 6,562,270 to Gannon et al. discloses a combination disposable cup insulator/stabilizer. Also, U.S. Pat. Nos. 3,372,830 to Edwards, 3,612,346 to Schneider, 4,548,348 to Clements, 4,867,313 to Padovani all disclose double-walled containers and cups. In addition, U.S. Pat. No. 3,337,109 to Shumrak discloses a sleeve disposed about at least a portion of a cup for insulating and supporting thereof.

In addition, stacking of containers including a lid has also been of interest in the past. One particular concern is stacking individual cups as well as respective sleeves for holding such cups, which may be addressed by proper sizing and design to allow stacking capability. However, another concern may be stacking containers and cups that are assembled with lids or sleeve structures. Conventional stacking approaches have been configured so that an upper cup sits upon the lid of a lower cup, such as U.S. Pat. No. 2,429,958 to Liebmann, U.S. Pat. No. 3,598,271 to Danforth, and U.S. Pat. No. 3,384,265 to Frank. However, conventional approaches appear to have not addressed stacking of containers or cups having sleeve structures disposed thereabout.

As may also be appreciated, due to the widespread use of cups and containers, particularly disposable cups, it would be advantageous to provide a container providing relatively good insulative qualities, stability against tipping, or both. Also, it would be advantageous to provide improved containers, such as insulated containers, cups, and assemblies thereof that may be stacked with relative stability.

BRIEF SUMMARY OF THE INVENTION

The present invention provides a container, such as, for instance, a cup having a sleeve structure, either integrally formed therewith or which may be assembled thereto, configured for insulating, stabilizing, or both insulating and stabilizing the cup or container. Particularly, a sleeve structure may preferably include a generally thin body or wall of which at least a portion thereof expands or tapers radially outwardly in a downward longitudinal direction. Such a configuration may provide enhanced stability relative to a container without such a sleeve structure. Accordingly, the present invention provides a container having a sleeve structure, which may be either integrally formed therewith or assembled thereto, configured for insulating, stabilizing, or both insulating and stabilizing the container.

In addition, a lid may be provided for substantially closing an opening of a first cup or container, the lid including at least one stabilizing feature for engaging at least a portion of a sleeve structure associated with a second cup or container, wherein the second cup or container is positioned longitudinally above and is substantially aligned or centered with respect to the first cup or container.

Also, a sleeve structure of the present invention, associated with a first cup or container, may include one or more stabilizing features, wherein the one or more stabilizing features are configured to engage another sleeve structure associated with, and assembled to, another cup or container disposed longitudinally thereabove in a stacked relationship.

In one embodiment, a sleeve structure of the present invention may include a plurality of circumferentially adjacent, longitudinally extending sections, separated circumferentially by cuts, formed in an upper region thereof. Circumferentially separated sections of a sleeve structure may be sized and configured to support a container disposed therein, either at the upper end of a container, or by way of complementary tapered walls of the container and sleeve structure engaging one another. Alternatively, circumferentially separated sections of a sleeve structure may be configured to be bent inwardly to form a radially outwardly tapering region, in an upward longitudinal direction, that is configured for holding or supporting a container disposed therein.

Alternatively, a sleeve structure of the present invention may include one or more frustoconical regions, wherein the frustoconical regions exhibit generally complementary tapers or opposing tapers with respect to one another. In addition, a sleeve structure of the present invention may include at least one region that is substantially cylindrical. Moreover, one frustoconical region of a sleeve structure may be positioned within another frustoconical region of the sleeve structure.

A container of the present invention may include one or more stabilizing features, wherein the one or more stabilizing features are configured to engage a sleeve structure associated with and assembled to another container disposed longitudinally above the container in a stacked relationship.

The present invention contemplates that any of the sleeves, sleeve structures, containers, cups, and lids described herein may be assembled, upon appropriate sizing, to fit with one another. Therefore, one or more containers, each including a sleeve structure, may be stacked in a longitudinal relationship wherein a lower container, including a lid disposed thereon, is longitudinally below an upper container, both containers having associated sleeve structures disposed thereabout, wherein at least one of the lower container, the lid, or the sleeve structure of the lower container comprises at least one stabilizing feature, the stabilizing feature sized and configured to engage the sleeve structure associated with the upper container disposed longitudinally thereabove.

Generally, any stabilizing features described may be fabricated separately from a lid, container, or sleeve structure of the present invention and may be configured to be selectively assembled, removed, or both assembled to and removed from a respective lid, container, or sleeve structure, without limitation. Additionally, a stabilizing feature of the present invention may be circumferentially separated from other stabilizing features, rather than a continuous peripheral feature of a cup, lid, or sleeve structure.

In another aspect of the present invention, a structure for preferentially retaining a sleeve structure of the present invention disposed therein is disclosed. The structure may include a raised portion extending from a base wherein the raised portion comprises a side wall defining a recess. Further, the side wall may comprise a lower groove formed therein, which forms an overhanging lip thereabove. Thus, the recess, lower groove, and overhanging lip may each be sized and configured so as to cooperatively preferentially retain a lower end of the sleeve structure disposed therein.

BRIEF DESCRIPTION OF THE SEVERAL VIEWS OF THE DRAWINGS

The foregoing and other advantages of the present invention will become apparent upon review of the following detailed description and drawings in which.

DETAILED DESCRIPTION OF THE INVENTION

It should be recognized that the present invention is not limited to cups or cup-like configurations. Rather, the present invention concerns containers, particularly containers with lids as well as sleeve structures disposed thereabout. Thus, while the embodiments, as illustrated, may be characterized as "cups," with respect to the illustrated geometries, any of such embodiments may apply to and be practiced in relation to containers, the main difference between containers and cups being the relative size and the shape of the interior thereof. Explaining further, in addition, while the present invention may be characterized as including annular walls, which may generally comprise cups and containers, it should be realized that containers may be configured in generally rectangular, generally square or cube-shaped, or generally circular or cylindrical configurations and in sizes and aspect ratios not normally utilized for beverage cups. Therefore, a "side wall" of a container or sleeve structure as used herein and described below may form a periphery that is rectangular, elliptical, circular, frustoconical, or as otherwise known in the art. Therefore, all such geometries, as known in the art, are included in the present invention, without limitation.

Figure 1A:
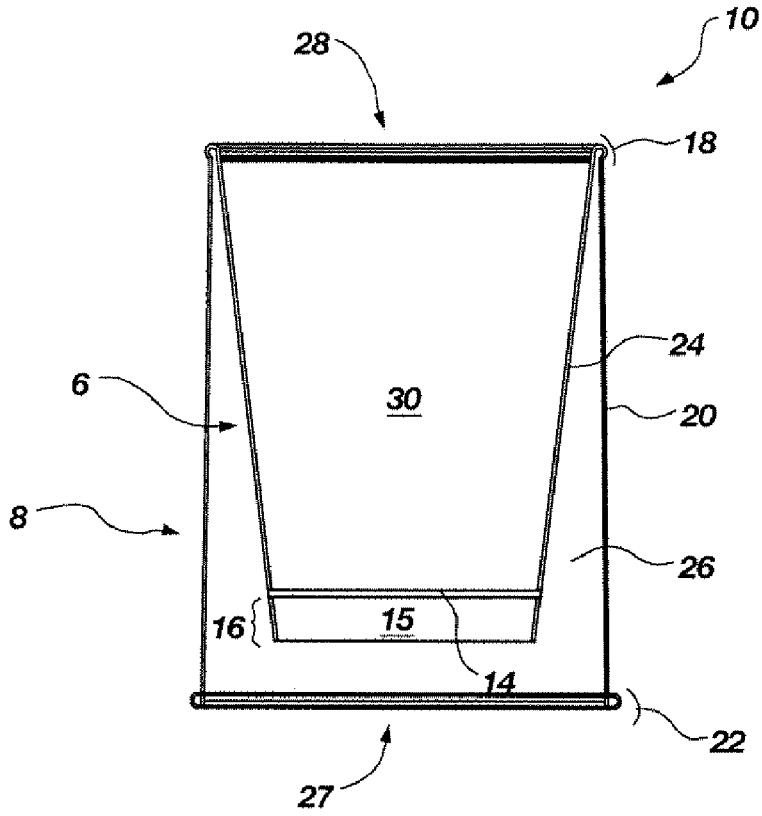
FIG. 1A shows a side cross-sectional view of an exemplary integral container and sleeve structure of the present invention.

FIG. 1A shows a side cross-sectional view of a first embodiment of insulated container 10 of the present invention. Insulated container 10 includes a container structure 6 and a sleeve structure 8, which are integrally formed with one another. Container structure 6 is defined, in part, by interior 30, which is formed by side wall 24 as well as radially inwardly extending lower wall 14. Insulated container 10 may generally exhibit radial symmetry about a longitudinal or central axis (not shown). Lower wall 14, as shown in FIG. 1A, may be positioned longitudinally along the inner surface of side wall 24. Although lower wall 14 is shown as a substantially horizontal, substantially planar geometry, the present invention is not so limited. Particularly, the lower wall 14 may be generally curved, in a concave or convex shape, substantially planar, partially hemispherical, conical, or as otherwise desired. Accordingly, container structure 6 may include an end recess 15 bounded by lower wall 14 as well as the stub portion 16 of side wall 24 that extends downwardly therepast. However, alternatively, side wall 24 may terminate at lower wall 14, and, therefore, may not form an end recess 15. Side wall 24 may taper radially inwardly as it extends longitudinally downward, as shown in FIG. 1A, or, alternatively, may extend from rolled rim 18 in a substantially vertical fashion, or may even taper radially outwardly, subject to the position of sleeve wall 20 of sleeve structure 8. Sleeve wall 20 may be formed integrally with rolled rim 18 and may extend generally therefrom, tapering radially outwardly as it extends longitudinally downward, to form space 26 between sleeve wall 20 and side wall 24. Also, sleeve wall 20 may have a lower radial extent that exceeds the radial extent of the lower wall 14. Such a configuration may provide enhanced stability to insulated container 10. Moreover, space 26 may insulate the contents of interior 30, (i.e., the contents being a hot liquid) from heat loss or gain through side wall 24, to or from, respectively, the environment surrounding sleeve wall 20. Therefore, insulated container 10, including container structure 6 and sleeve structure 8 disposed thereabout may advantageously provide a relatively stable, insulated structure for containing a liquid, such as a hot or cold beverage.

Rolled rim 18, positioned at the upper longitudinal end of insulated container 10 and defining opening 28, may stiffen or inhibit excessive bending or deformation of insulated container 10 during use, and particularly during gripping by a user. Likewise, sleeve wall 20 may include rolled rim 22 at its lower longitudinal end, which may strengthen, provide resistance to bending or deformation during use, and to generally support insulated container 10. Alternatively or additionally, rolled rim 22 may be sized and configured to be received within a holding structure, as discussed in more detail hereinbelow. Rolled rim 22 defines opening 27 at the lower longitudinal end of sleeve wall 20.

Insulated container 10 of the present invention may be formed by way of vacuum forming or thermoforming. For instance, thermoforming may describe the process wherein a flat sheet of material, usually plastic, is heated and formed by molding in the presence of a vacuum, pressure, or both, to conform to and assume at least a portion of, the shape of one or more mold components. Alternatively, matched mold thermoforming or other thermoforming may be used to fabricate insulated container 10. Plastics that may be particularly suited for use in thermoforming processes include: acrylonitrile-butadiene-styrene copolymer (ABS), high-impact polystyrene (HIPS), high density polyethylene (HDPE), high molecular weight polyethylene (HMWPE), polypropylene (PP), polyvinyl chloride (PVC), polymethyl methacrylate (PMMA), and polyethylene terephthalate modified with CHDM (PETG). In another alternative, injection molding may be used to form insulated container 10. Accordingly, insulated container 10 may be formed of any of the above-mentioned plastics or others, according to thermoforming processes, injection molding processes, or as otherwise known in the art.

Figure 1B:
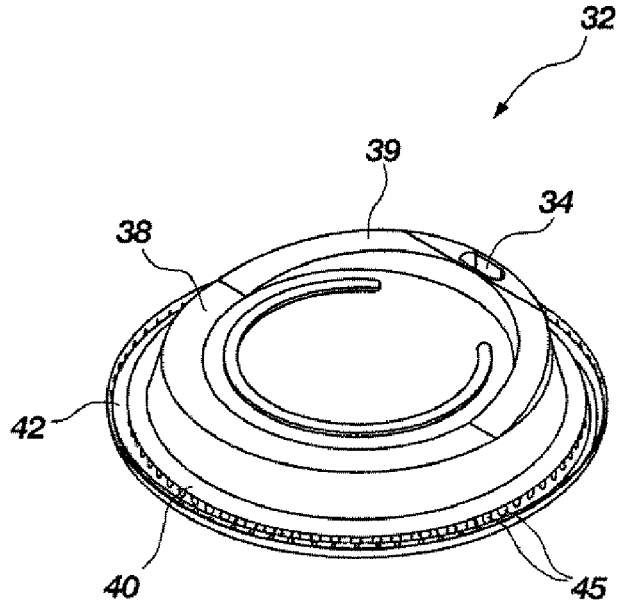
FIG. 1B shows a perspective view of an exemplary lid of the present invention.
Figure 1C:
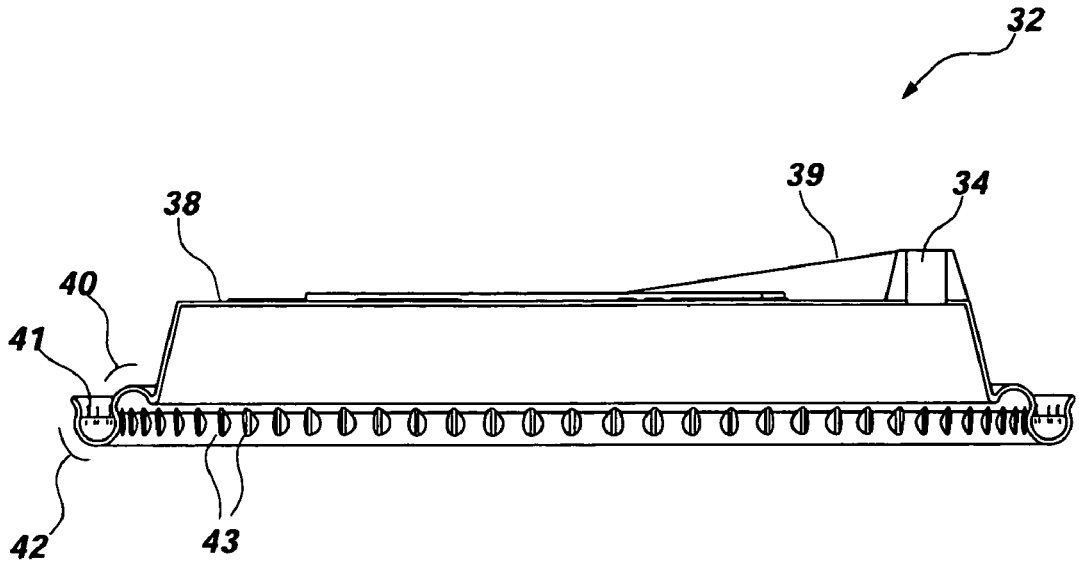
FIG. 1C shows a side cross-sectional view of the lid shown in FIG. 1B.
Figure 1D:
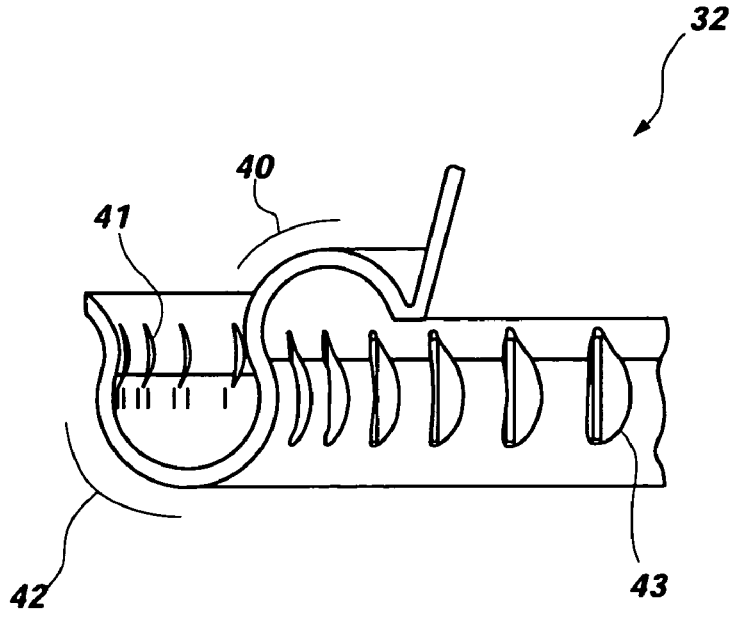
FIG. 1D shows an enlarged partial side cross-sectional view of the lid shown in FIGS. 1B and 1C.
Figure 1E:
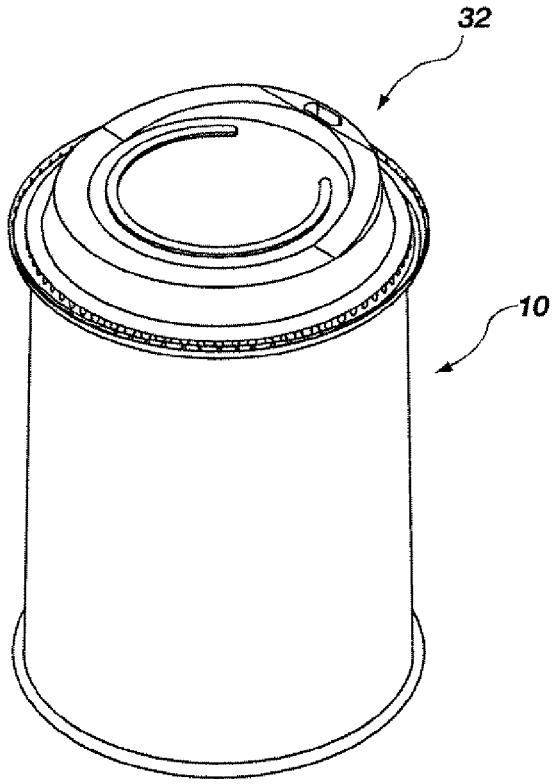
FIG. 1E shows a perspective view of an assembly of the integral container and sleeve structure shown in FIG. 1A and the lid shown in FIGS. 1B-1D.
Figure 1F:
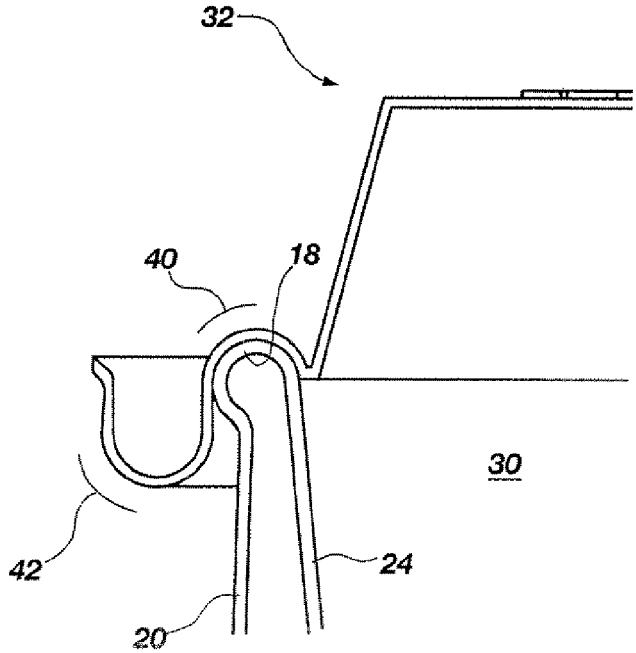
FIG. 1F shows an enlarged partial cross-sectional view of the assembly shown in FIG. 1E.

Further, FIGS. 1B, 1C and 1D show a perspective view, a cross-sectional view, and an enlarged partial cross-sectional view of lid 32, respectively, wherein lid 32 is configured for use with insulated container 10. Accordingly, lid 32 may be sized and configured to substantially close opening 28 of insulated container 10. Lid 32 may also be generally formed as a relatively shallow radially extending upside-down dish, which may include a centrally raised portion 38 as well as raised drinking lip portion 39. Further, lid 32 may include, near its outer radial periphery, a downwardly oriented arcuate recess 40, which may be sized and configured to matingly engage against at least a portion of upper rolled rim 18 of insulated container 10. Of course, downwardly oriented arcuate recess 40 may be sized and configured to conformably engage against at least a portion of upper rolled rim 18 of insulated container 10, meaning that at least a portion of the downwardly oriented arcuate recess 40 may be shaped to substantially conform to and accept at least a portion of upper rolled rim 18. Accordingly, lid 32 may be disposed proximate the opening 28 of insulated container 10, and about upper rolled rim 18, as shown in FIGS. 1E and 1F, depicting a perspective view of lid 32 disposed on insulated container 10 and an enlarged partial cross-sectional view of lid 32 disposed on insulated container 10, respectively. As shown in FIG. 1F, downwardly oriented arcuate recess 40 may matingly engage and substantially conformably fit against at least a portion of upper rolled rim 18 of insulated container 10.

While not shown in FIG. 1F, for clarity, in addition, lid 32 may include a plurality of vertically oriented depressions 43 (FIG. 1D), which may facilitate retention, removal, or both of rolled rim 18 of insulated container 10 disposed generally within downwardly oriented arcuate recess 40. For instance, the edges of the vertically oriented depressions 43 may inhibit rotation or removal of a rolled rim 18 disposed generally within downwardly oriented arcuate recess 40. On the other hand, vertically oriented depressions 43 may allow air to communicate with the downwardly oriented arcuate recess 40, which may facilitate positioning or retention of rolled rim 18 generally therein as well as facilitating removal of rolled rim 18 therefrom. Thus, the size and position of vertically oriented depressions 43 within downwardly oriented arcuate recess 40 may be configured for retention, removal, or both of rolled rim 18 in relation to downwardly oriented arcuate recess 40. It should further be noted that, generally, substantially vertically oriented depressions such as the vertically oriented depressions 43 described above may be employed upon the cups, sleeve structures, or lids of the present invention without limitation.

Referring to FIGS. 1B and 1C, lid 32 may include aperture 34 for allowing or facilitating the contents of insulated container 10 to flow from the interior 30 thereof. While not completely sealing opening 28, since aperture 34 may allow flow therethrough, the presence of lid 32 may substantially close opening 28, and reduce the ability of the contents of interior 30 of insulated container 10 to escape therefrom (i.e., by liquid splashing against side wall 24). Aperture 34 may be sized and configured for communication of a liquid from within the interior 30 of insulated container 10 to flow therethrough, upon sufficient tipping of the insulated container 10, and, optionally, another smaller aperture (not shown) may be sized and configured to allow air to be drawn into the interior 30 of insulated container 10 if the larger aperture 34 becomes sealed, either by fluid flowing therethrough or by a person's mouth during drinking.

Figure 1G:
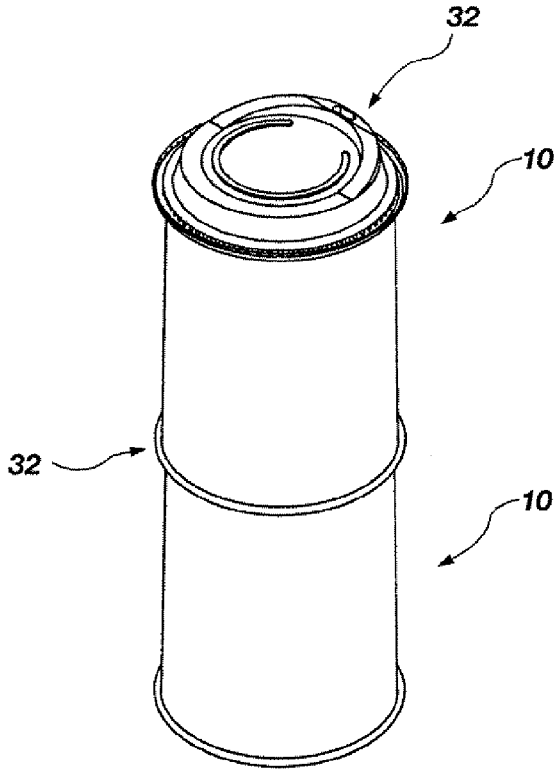
FIG. 1G shows a perspective view of a stacked assembly of two of the assemblies shown in FIG. 1E.

Generally, a lid according to the present invention may also include at least one stabilizing feature sized and configured, when the lid is disposed onto a first container, to matingly engage a sleeve structure of a second container, where the second container is positioned longitudinally thereabove and substantially centered in relation thereto as shown in FIG. 1G, and described in more detail hereinbelow. Accordingly lid 32, as shown in FIGS. 1B, 1C, and 1D includes stabilizing feature 42, which, when disposed upon a first insulated container 10, may be sized and configured to matingly engage the sleeve structure of another insulated container 10, upon the another insulated container 10 being positioned longitudinally thereabove and substantially centered in relation thereto. More particularly, stabilizing feature 42 is configured geometrically as an upwardly oriented arcuate recess.

More specifically, stabilizing feature 42 may be configured as an upwardly oriented arcuate recess, groove, or depression extending circumferentially about the outer radial periphery of the lid 32. Such a configuration may allow for the stabilizing feature 42 to engage the lower rolled rim 22 of upper insulated container 10 to stabilize or hold the upper insulated container 10 and the lower insulated container 10 in a stacked relationship or fashion. Therefore, advantageously, providing a first insulated container 10 with a lid 32 as described above may allow for a second insulated container 10 to be disposed longitudinally thereabove with relative stability, as depicted in FIG. 1G.

Figure 1H:
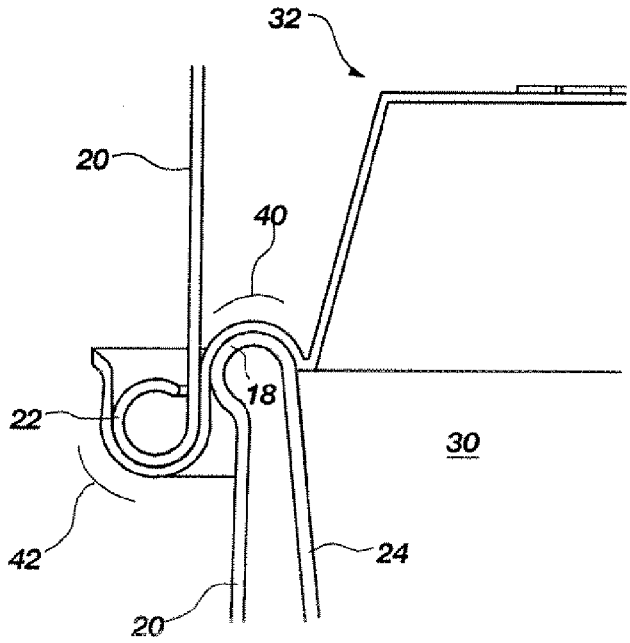
FIG. 1H shows an enlarged partial cross-sectional view of the assembly shown in FIG. 1G.

Also, while not shown in FIG. 1H, for clarity, lid 32 may include a plurality of radial protuberances 45 (FIG. 1B) disposed about the circumference of stabilizing feature 42 and associated with vertically oriented depressions 43 (FIG. 1D) may extend from the inner surface of stabilizing feature 42 and may be sized and configured to compress, position, or both compress and position a rolled rim of a sleeve wall disposed therein. Further, a plurality of vertically oriented depressions 41 (FIG. 1D) may be formed in the radial outer wall of stabilizing feature 42, disposed circumferentially thereabout and may be configured to allow air to communicate with the stabilizing feature 42, which may facilitate disposal of a rolled rim therein as well as removal of a rolled rim therefrom. In addition, vertically oriented depressions 41 may be configured to retain or position a rolled rim within stabilizing feature 42.

Figure 1I:
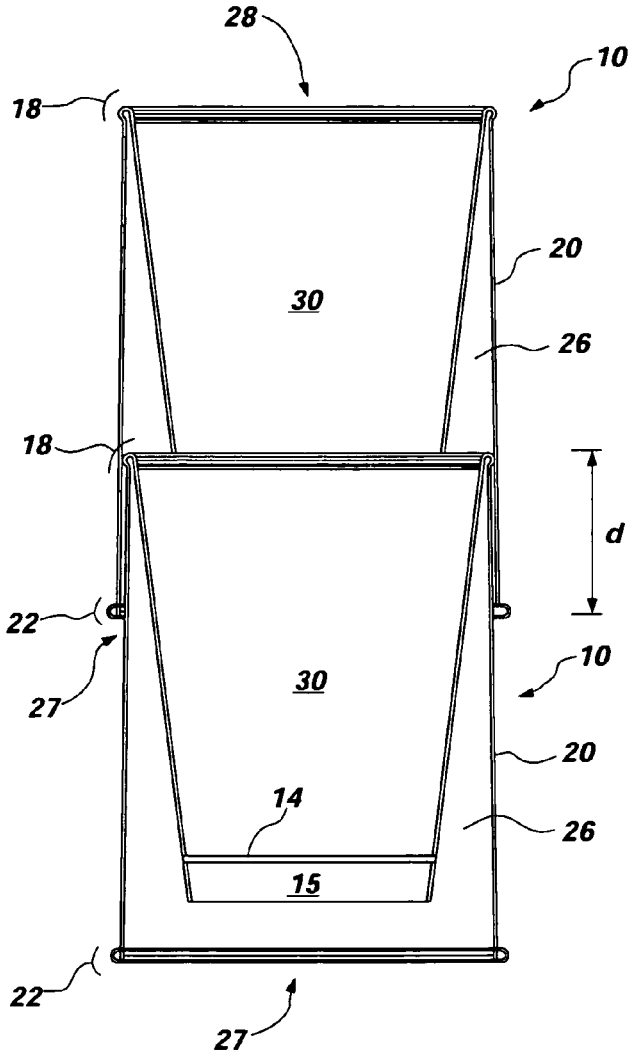
FIG. 1I shows a side cross-sectional view of two stacked integral container and sleeve structures as shown in FIG. 1A.

However, another desirable feature for containers, especially disposable containers, may be the ability to stack one within another. More specifically, the ability to stack containers or containers in high density, that is, nesting or stacking as many containers in as diminutive a volume as possible, may be a desirable attribute for ease in shipping, handling, and storing such containers. As may be seen in reference to FIG. 1I, the overlap distance between a first insulated container 10 and a second, identical, insulated container 10, may not provide as much stacking density as may be desired, particularly for disposable containers.

Figure 2A:
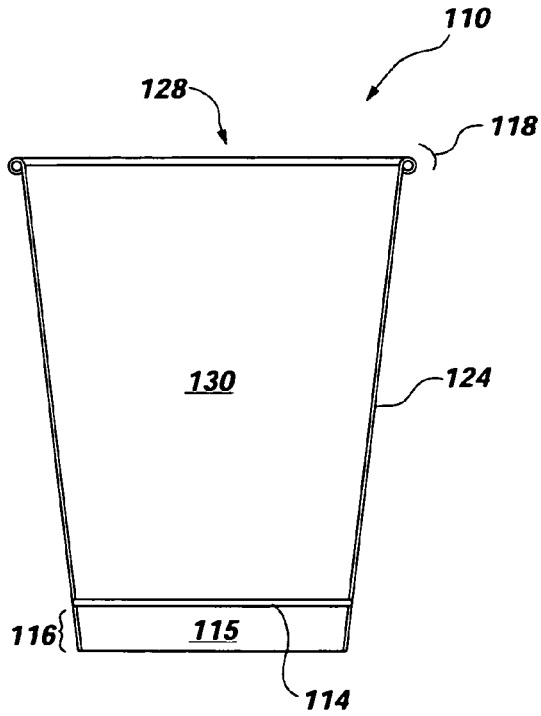
FIG. 2A shows a side cross-sectional view of an exemplary container of the present invention.

In a further embodiment of the present invention, a sleeve structure may be fabricated separately from, and configured to be selectively disposed about and removed from, a container, or at least a portion thereof. As shown in FIG. 2A, container 110 may generally exhibit radial symmetry about a longitudinal or central axis (not shown) about which side wall 124 is disposed and may include radially inwardly extending lower wall 114 positioned longitudinally thereabout. Thus, container 110 may be defined, in part, by interior 130 thereof. Lower wall 114 may be arcuate, convex, concave, substantially planar, partially hemispherically, conically, or shaped as otherwise desired. Container 110 may further include an end recess 115 bounded by lower wall 114 as well as a stub portion 116 of side wall 124 that extends downwardly therepast. Upper rolled rim 118 may be formed at the upper longitudinal end of container 110, defining opening 128, which may stiffen or resist excessive bending or deformation of container 110 during use.

Figure 2B:
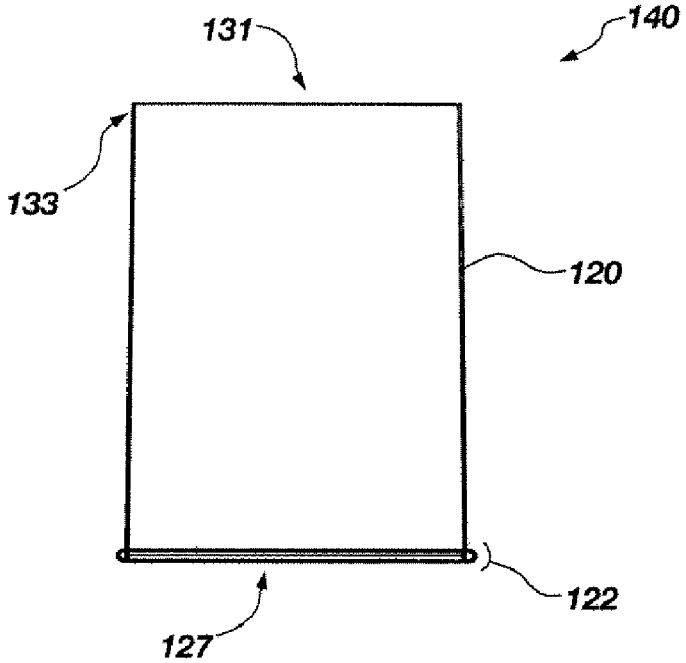
FIG. 2B shows a side cross-sectional view of an exemplary sleeve structure of the present invention.

Further, as shown in FIG. 2B, sleeve structure 140 may comprise a radially outwardly tapering sleeve wall 120, as it extends longitudinally downward, which may be sized and configured to be disposed about and engage at least a portion of container 110. Of course, alternatively, sleeve wall 120 may exhibit radial inward taper or no radial taper as it extends longitudinally downward. Sleeve wall 120 may be configured with an upper end 133, defining opening 131, where upper end 133 may be configured to matingly engage against at least a portion of upper rolled rim 118 of container 110. Further, sleeve structure 140 may include rolled rim 122, formed at the lower longitudinal end thereof, with the inner radial portion of rolled rim 122 forming opening 127. Sleeve structure 140 may be configured, upon assembly about container 110, to insulate, support, or both support and insulate container 110.

Figure 2C:
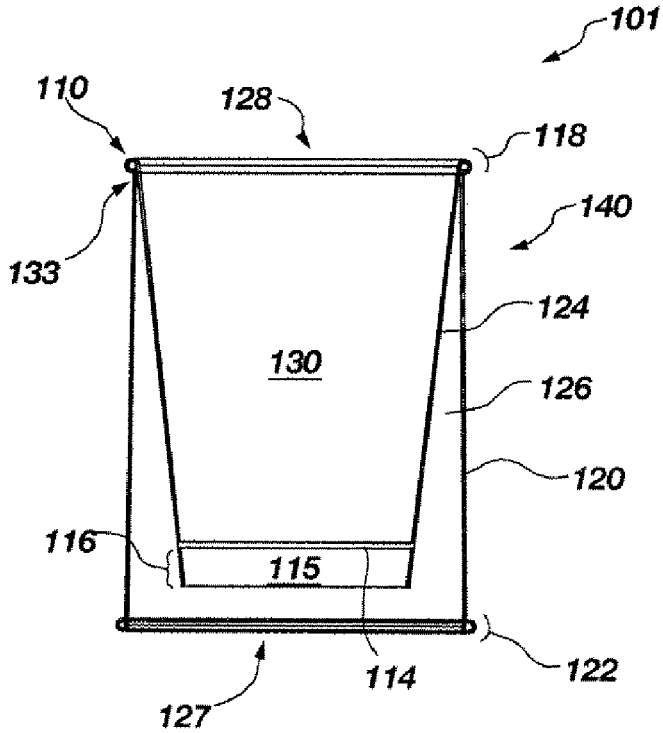
FIG. 2C shows a side cross-sectional view of an assembly of the container shown in FIG. 2A and the sleeve structure shown in FIG. 2B.

More particularly, FIG. 2C shows assembly 101 including sleeve structure 140 disposed about at least a portion of container 110. Upper end 133 of sleeve structure 140 may matingly engage at least a portion of upper rim 118 of container 110, to provide support thereto. Sleeve structure 140 is shown as suspending container 110 longitudinally therein, since the rolled rim 122 of sleeve structure 140 would contact a flat surface upon which assembly 101 may be placed. As may be appreciated, the relative heights of container 110 and sleeve structure 140 may be configured so that the stub portion 116 of side wall 124 extends longitudinally past opening 127 of sleeve structure 140. Alternatively, the relative heights of container 110 and sleeve structure 140 may be configured so that the stub portion 116 extends to a position substantially level with the rolled rim 122.

Thus, sleeve wall 120 may extend generally from the upper end of container 110, tapering radially outwardly as it extends longitudinally downward, to form space 126 between sleeve wall 120 and side wall 124. Additionally, sleeve wall 120 includes a lower radial extent that exceeds the radial extent of the lower end of stub portion 116 of side wall 124. Such a configuration may provide enhanced stability to container 110 upon disposing sleeve structure 140 thereabout. Moreover, space 126 may insulate the contents of interior 130 of container 110, (i.e., the contents being a hot or cold liquid) from heat loss or gain through side wall 124, to or from, respectively, the environment surrounding sleeve wall 120.

Figure 2D:
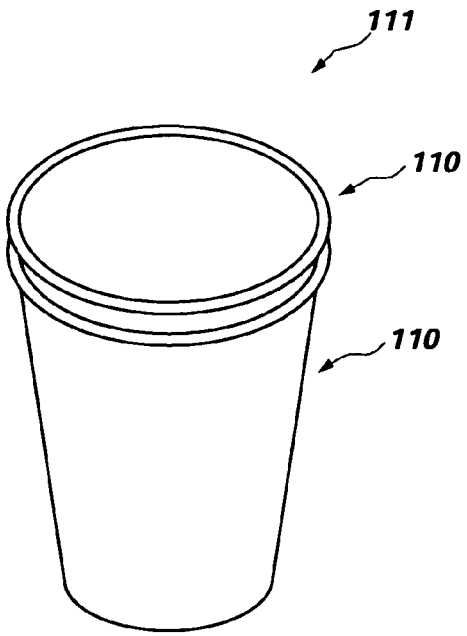
FIG. 2D shows a perspective view of an assembly of two containers as shown in FIG. 2A in a stacked relationship.
Figure 2E:
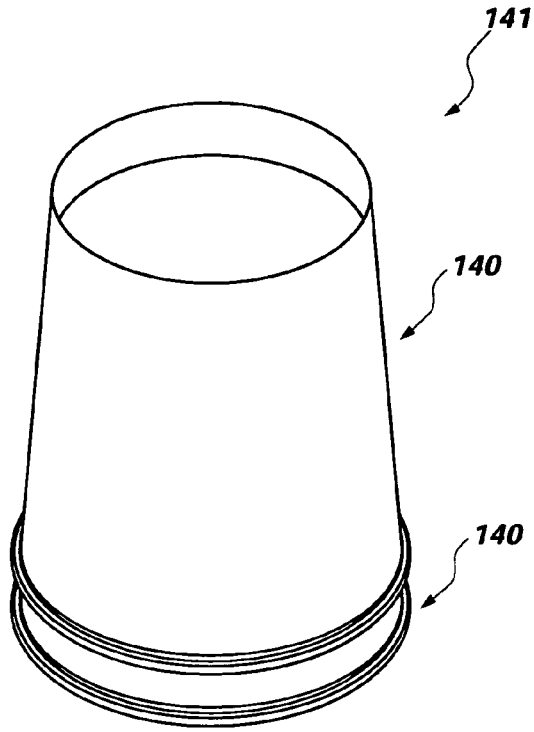
FIG. 2E shows a perspective view of an assembly of two sleeves as shown in FIG. 2B in a stacked relationship.

Such a configuration may provide improved stacking of the container 110 and sleeve structure 140 separately than would be attainable if the sleeve structure 140 were formed integrally with the container 110, as shown in FIG. 1A with respect to insulated container 10. Particularly, FIG. 2D shows a perspective view of the improved stacking characteristics of an assembly 111 of two containers 110, wherein one container 110 is stacked within the other container 110, while FIG. 2E shows a perspective view of the improved stacking characteristics of assembly 141 including two sleeve structures 140, wherein one sleeve structure 140 is stacked within another sleeve structure 140. Such a configuration may provide improved packaging density for shipping, handling, and storage for assemblies of stacked containers 110 and assemblies of stacked sleeve structures 140.

Therefore, as may be recognized by the foregoing descriptions and embodiments, the present invention provides a container having a sleeve structure, either integrally formed therewith or which may be assembled thereto, configured for insulating, stabilizing, or both insulating and stabilizing the container. Further, a lid may be provided for substantially closing an opening of a first container, the lid including at least one stabilizing feature for engaging at least a portion of a sleeve structure associated with a second container, wherein the second container is positioned longitudinally above and is substantially aligned or centered with respect to the first container. Of course, there are many variations of the present invention which may be apparent to one of ordinary skill in the art. For instance, there are many embodiments of lids which may include a stabilizing feature suited to engage a sleeve structure.

Figure 3A:
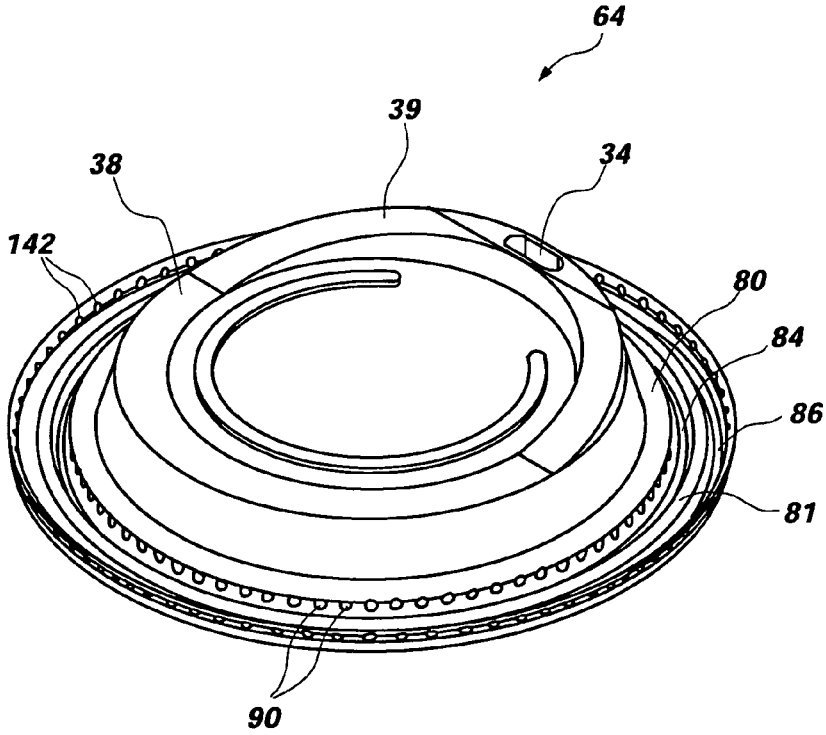
FIG. 3A shows a perspective view of another exemplary lid of the present invention.
Figure 3B:
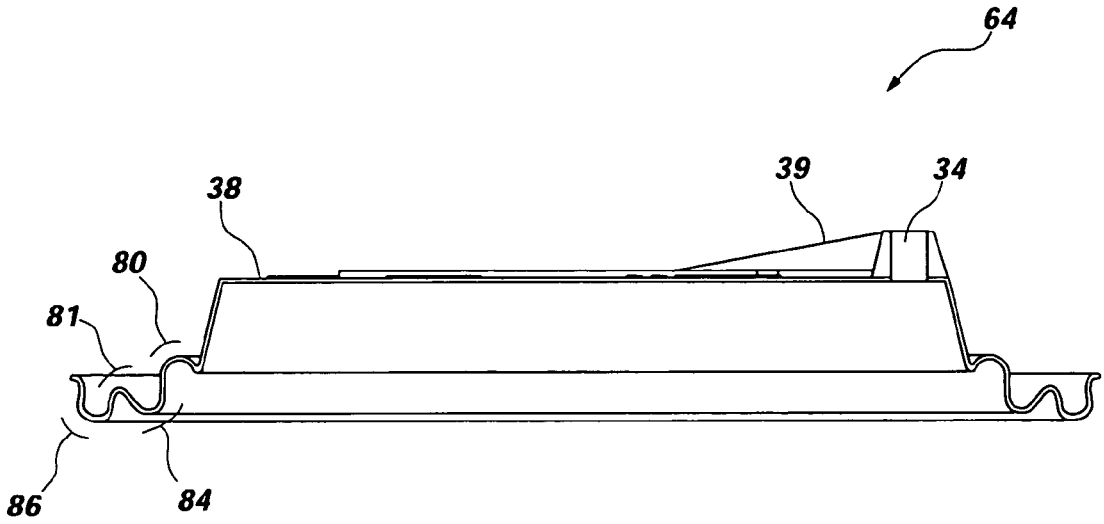
FIG. 3B shows a side cross-sectional view of the lid shown in FIG. 3A.

For instance, FIGS. 3A and 3B show an exemplary embodiment of lid 64 in perspective and side cross-sectional views, respectively. Lid 64 may be sized and configured to substantially close opening 128 of container 110 and may allow flow therethrough while reducing the ability of the contents of interior 130 of container 110 to escape therefrom (i.e., by liquid splashing against side wall 124). Lid 64 may also be generally formed as a relatively shallow radially extending upside-down dish, which may include a centrally raised portion 38 as well as raised drinking lip portion 39. Also, lid 64 may include, positioned radially outward from raised portion 38, a first downwardly oriented arcuate recess 80, which may be sized and configured to matingly engage against at least a portion of upper rolled rim 118 of container 110, so as to substantially close the opening 128 of insulated container 110 when first downwardly oriented arcuate recess 80 is disposed upon rolled rim 118 of container 110. Alternatively, second downwardly oriented arcuate recess 81 may be configured to matingly engage against at least a portion of a rolled rim of a container.

Lid 64 may include a plurality of vertically oriented depressions (not shown), which may facilitate retention, removal, or both of rolled rim 118 of insulated container 110 disposed generally within downwardly oriented arcuate recess 80, as described hereinabove in relation to vertically oriented depressions 43. Also, while not shown in FIG. 3B, for clarity, lid 64 may include a plurality of protuberances 90 (FIG. 3A) disposed about the circumference of upwardly oriented arcuate recess 84 and associated with vertically oriented depressions (not shown), as described hereinabove in relation to vertically oriented depressions 43. Further, a plurality of vertically oriented depressions 142 (FIG. 3A) may be formed in the radial outer wall of stabilizing feature 86, disposed circumferentially thereabout as discussed hereinabove in relation to vertically oriented depressions 141.

Stabilizing feature 86, as shown in FIGS. 3A and 3B as a upwardly oriented arcuate recess, when lid 64 is disposed upon a first container 110, may be sized and configured to matingly engage the sleeve structure of another container 110, upon the another container 110 being positioned longitudinally thereabove and substantially centered in relation thereto. Alternatively, upwardly oriented arcuate recess 84, when lid 64 is disposed upon a first container 110, may be sized and configured to matingly engage the sleeve structure of another container 110, upon the another container 110 being positioned longitudinally thereabove and substantially centered in relation thereto. Therefore, a series of undulating grooves positioned proximate the outer radially extending portion of lid 64 may form one or more stabilizing features as well as one or more downwardly oriented arcuate recesses for engaging a rolled rim of a container.

It should be understood that lid 64 may be used with any suitable container disclosed herein, such as container 10 or container 110, without limitation. However, lid 64 may be particularly advantageous for use with a sleeve structure that is tapered more than, and therefore exhibits a rolled rim that is larger in diameter than, the rolled rim 122 of sleeve structure 140 as shown in FIG. 2B. Alternatively, lid 64 may be desirable for use with a container that is smaller than, and therefore exhibits a rolled rim that is smaller in diameter than the rolled rim 118 of container 110 as shown in FIG. 2A. Also in the alternative, lid 64 may be particularly advantageous when two different sizes of container or sleeve may be used in combination with one another. Explaining further, the downwardly oriented arcuate recesses 80 and 81 may be sized and configured to engage the rolled rims of two differently sized containers. Similarly, stabilizing feature 86 may be configured to engage a sleeve structure of a first size, while upwardly oriented arcuate recess 84 may also be configured as a stabilizing feature which is configured to engage a sleeve structure of a second size.

Figure 3C:
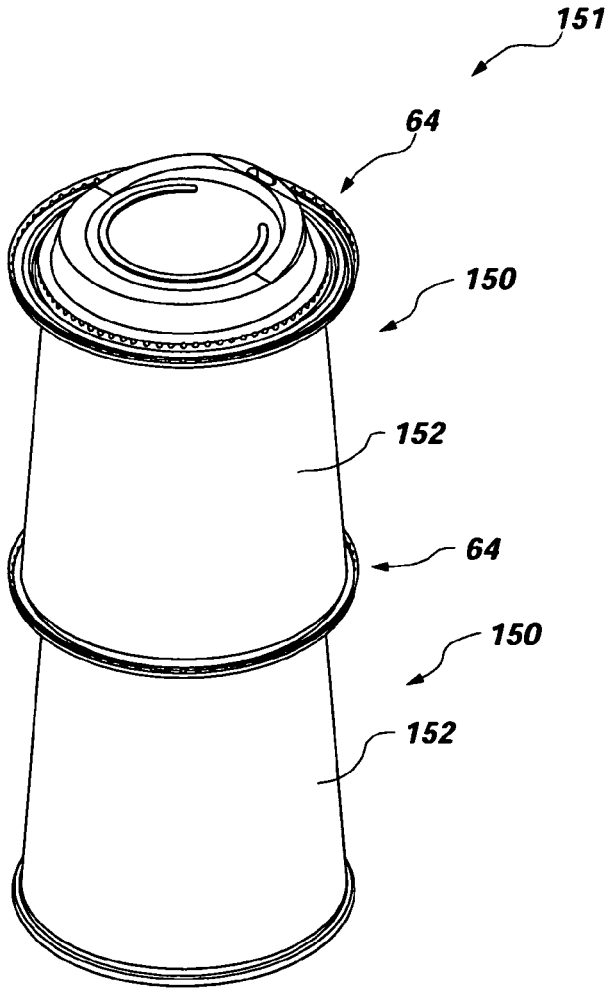
FIG. 3C shows a stacked assembly of two lids as shown in FIGS. 3A and 3B, two containers, and two sleeve structures.
Figure 3D:
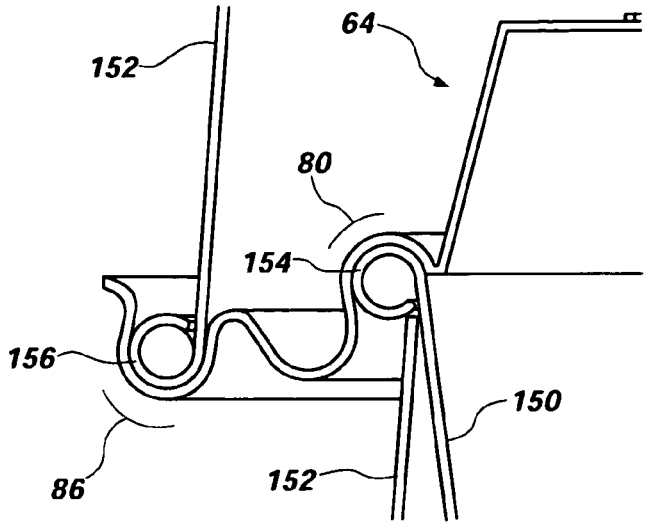
FIG. 3D shows an enlarged partial cross-sectional view of the assembly shown in FIG. 3C.

Lid 64 may be used to form an assembly 151, as shown in FIG. 3C in a side perspective view, wherein assembly 151 includes a first container 150 and a second container 150, both of which may be configured as described above with respect to container 110, wherein first container 150 is positioned longitudinally below and substantially aligned or centered with second container 150. As shown in FIG. 3C, first lid 64 may be disposed upon first container 150 and first sleeve structure 152 may be disposed about at least a portion of first container 150. More particularly, as shown in FIG. 3D, rolled rim 154 of first container 150 may be at least partially disposed within downwardly oriented arcuate recess 80. Similarly, second lid 64 may be disposed upon second container 150 and second sleeve structure 152 may be disposed about at least a portion of second container 150. Containers 150 and associated sleeve structures 152 may be sized and configured so that at least a portion of lower rolled rim 156 of first sleeve structure 152 fits into stabilizing feature 86 of first lid 64, as shown in FIG. 3D. It should be understood that the present invention is not limited to assemblies of two cups or cup assemblies. Rather, the present invention may be employed to form cup or cup assemblies of two or more cups or containers, without limitation.

Figure 4A:
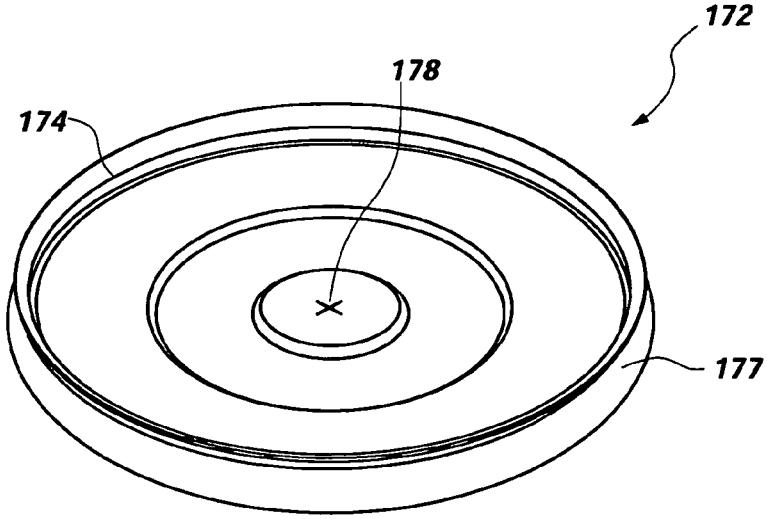
FIG. 4A shows a perspective view of a further exemplary lid of the present invention.
Figure 4B:
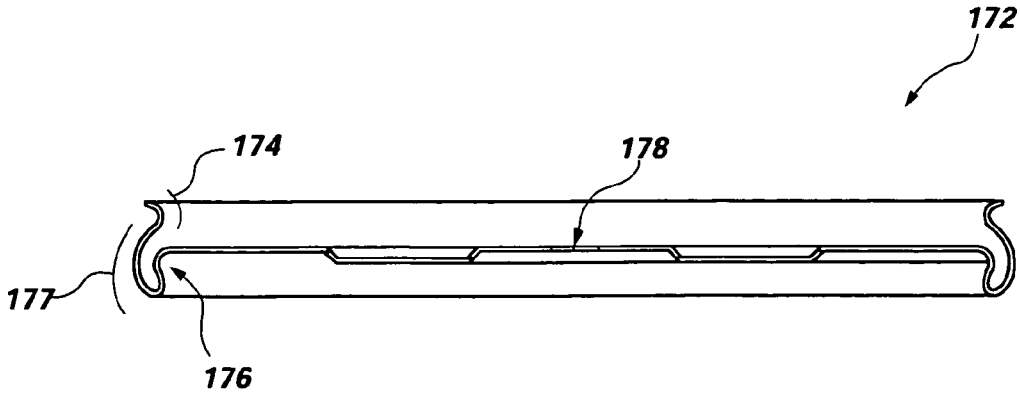
FIG. 4B shows a side cross-sectional view of the lid shown in FIG. 4A.

FIGS. 4A and 4B show another exemplary embodiment of a lid 172 of the present invention in perspective and side cross-sectional views, respectively. Perforations 178 may be formed generally centrally through lid 172 and may be configured to allow a straw to be positioned therethrough. Lid 172 may be a generally radially symmetric extending body forming a downwardly oriented arcuate recess 176, an arcuate outer wall 177, and stabilizing feature 174, where stabilizing feature 174 is configured as an inwardly radial protrusion. Downwardly oriented arcuate recess 176 may be sized and configured to matingly engage against at least a portion of upper rolled rim 118 of container 110, so as to substantially close the opening 128 of insulated container 110 when first downwardly oriented arcuate recess 176 is disposed upon rolled rim 118 of container 110. Stabilizing feature 174 may be sized and configured to matingly engage against at least a portion of a sleeve structure associated with a container disposed thereabove.

Figure 4C:
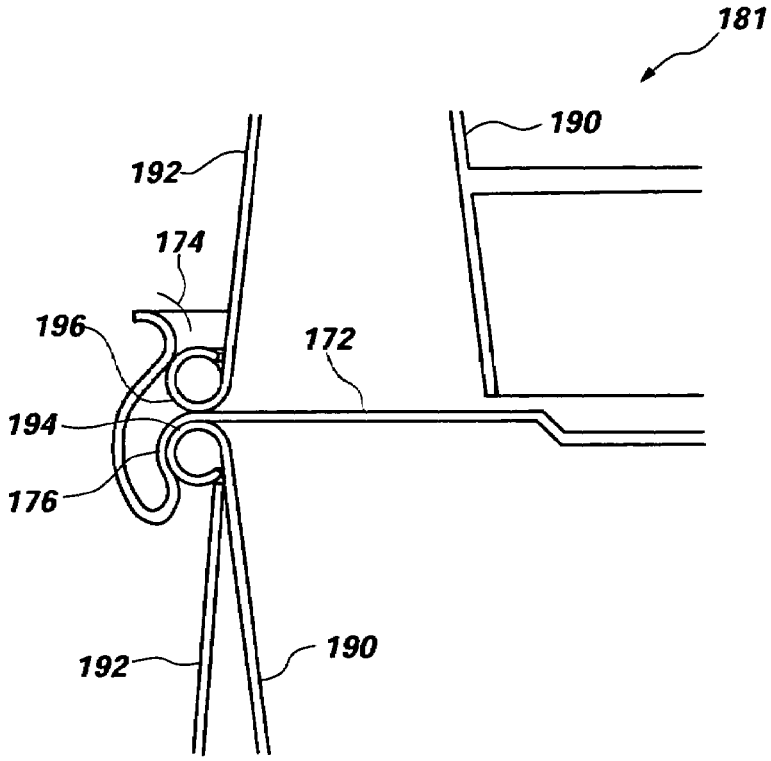
FIG. 4C shows an enlarged partial cross-sectional view of an exemplary assembly of two lids as shown in FIGS. 4A and 4B, two containers, and two sleeve structures.

More specifically, lid 172 may be used to form an assembly 181, as shown in FIG. 4C in an enlarged partial side cross-sectional view, wherein assembly 181 includes a first container 190 and a second container 190, both of which may be configured as described above with regard to container 110, wherein first container 190 is positioned longitudinally below and substantially aligned or centered with second container 190. First lid 172 is disposed upon first container 190 and first sleeve structure 192 is disposed about at least a portion of first container 190. Rolled rim 194 of first container 190 may be sized and configured to matingly engage at least a portion of downwardly oriented arcuate recess 176. Further, containers 190 and associated sleeve structures 192 may be sized and configured so that at least a portion of lower rolled rim 196 of first sleeve structure 192 may abut against at least a portion of stabilizing feature 174, as shown in FIG. 4C.

Figure 5A:
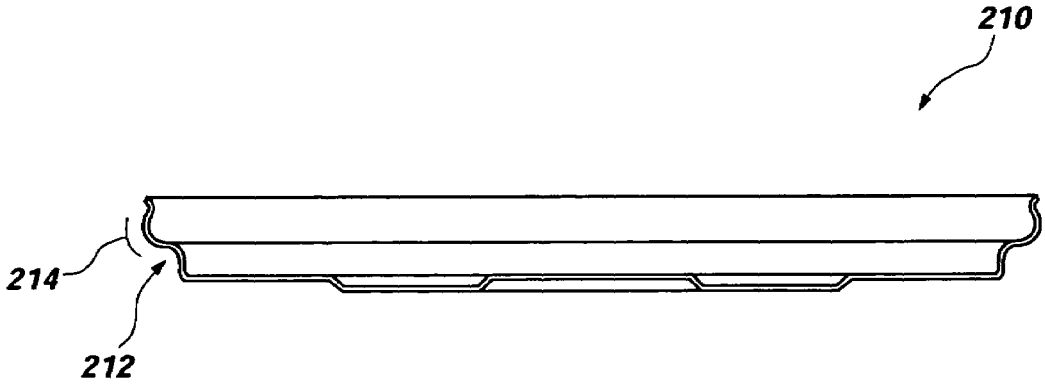
FIG. 5A shows a side cross-sectional view of yet another exemplary lid of the present invention.
Figure 5B:
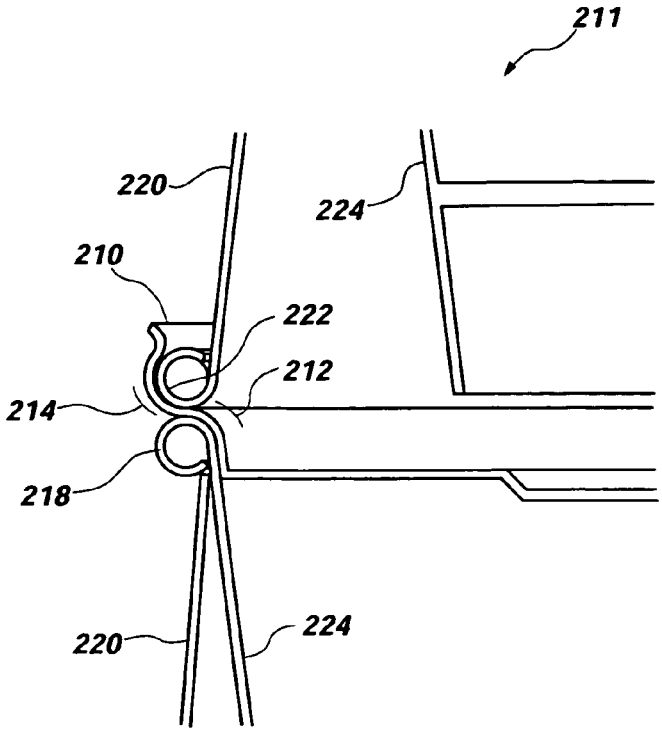
FIG. 5B shows an enlarged partial cross-sectional view of an exemplary assembly of two lids as shown in FIG. 5A, two containers, and two sleeve structures.

In a further embodiment of a lid of the present invention, lid 210 is shown in a side cross-sectional view in FIG. 5A and may comprise a generally radially symmetric extending body forming a rounded depression 212 and a stabilizing feature 214, where stabilizing feature 214 is configured as an upwardly oriented arcuate recess. Rounded depression 212 may be sized and configured to matingly engage against at least a portion of a container, so as to substantially close the opening thereof. Stabilizing feature 214 may be sized and configured to matingly engage against at least a portion of a sleeve structure associated with another container disposed thereabove. More specifically, as shown in FIG. 5B, lid 210 may be used to form an assembly 211, including two containers 224, two sleeve structures 220, and at least one lid 210. FIG. 5B shows an enlarged partial side cross-sectional view of assembly 211, including a first container 224 and a second container 224, both of which may be configured as container 110, as described above, wherein first container 224 may be positioned longitudinally below and substantially aligned or centered with second container 224. Lid 210 may be disposed upon first container 224 and first sleeve structure 220 may be disposed about at least a portion of first container 224. Rolled rim 218 of first container 224 and rounded depression 212 may each be sized and configured to matingly engage at least a portion of one another. Further, containers 224 and associated sleeve structures 220 may be sized and configured so that at least a portion of lower rolled rim 222 of first sleeve structure 220 may abut against at least a portion of stabilizing feature 214.

Figure 6:
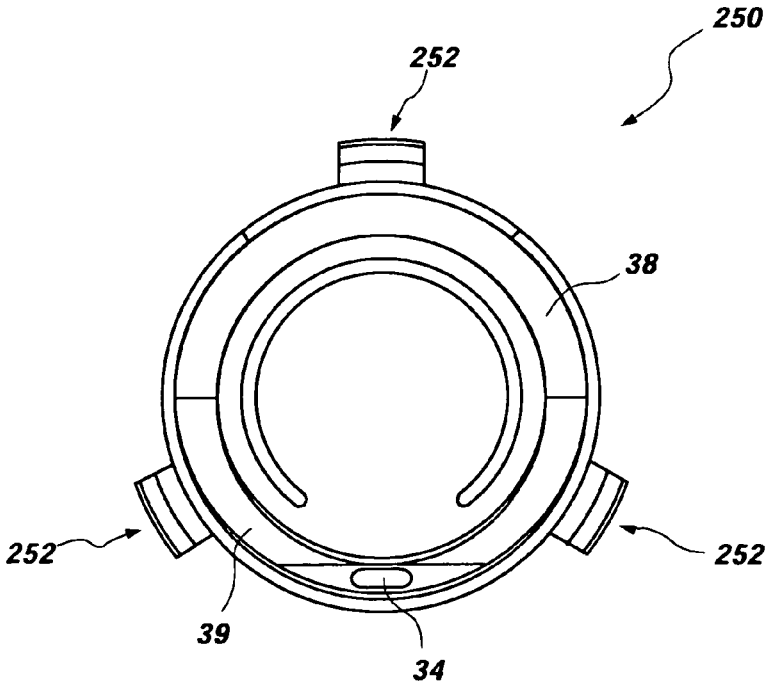
FIG. 6 shows a top view of an exemplary lid of the present invention including separated stabilizing features.

As yet another aspect of the present invention, a stabilizing feature of a lid of the present invention may be an isolated radial extension therefrom, rather than a continuous peripheral feature as depicted in the above-described embodiments. Specifically, FIG. 6 shows a lid 250 of the present invention including three circumferentially separated stabilizing features 252, extending, accordingly, from three different circumferential positions about the periphery of lid 250. Stabilizing features 252 may be configured according to any of the stabilizing features described herein, or combinations thereof, without limitation. Such a configuration may use less material than continuous peripheral stabilizing features and may allow for the stabilizing features 252 to be easily removed, if desired, by bending and breaking the stabilizing features from the lid 250. Of course, the stabilizing features 252 may include perforations (not shown) near their connection to lid 250 to facilitate separation therefrom. Alternatively, stabilizing features 252 may be fabricated separately from lid 250 and configured to be selectively assembled to and removed from lid 250.

The present invention also contemplates that a sleeve structure for insulating, stabilizing, or both insulating and stabilizing a container may comprise many different embodiments. In addition, while different embodiments of sleeve structures of the present invention may be described and shown as annular sections, a sleeve structure of the present invention need not be a continuous annular form. Rather, the sleeve structure of the present invention may be a substantially flat sheet that is bent or formed into a substantially annular form. More specifically, a sleeve structure of the present invention may be a substantially flat sheet that is configured with one or more slot features for accepting a corresponding one or more tab features, wherein disposing the one or more tab features within the one or more slot features may affix, constrain, or hold the flat sheet in a substantially annular or frustoconical configuration. In addition, it is contemplated that a sleeve structure of the present invention may comprise many different geometries and configurations, such as generally cubic, generally cylindrical, box-shaped, parabolic, or as otherwise desired.

Figure 7A:
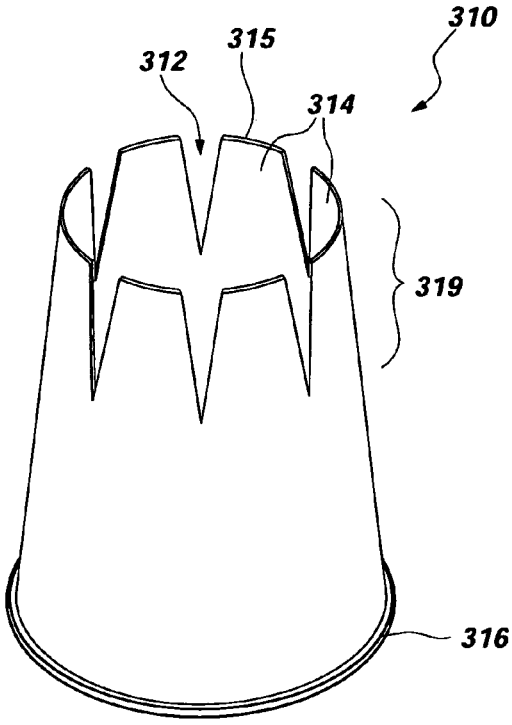
FIG. 7A shows a perspective view of an exemplary sleeve structure of the present invention including circumferentially separated sections.

For instance, FIG. 7A shows one embodiment of sleeve structure 310 of the present invention which includes a generally annular body, which tapers radially inwardly as it extends longitudinally upwardly away from a rolled rim 316 positioned at its lower longitudinal end. Sleeve structure 310 may also include a plurality of circumferentially adjacent, longitudinally extending sections 314, separated circumferentially by cuts 312 formed in an upper region 319, the sections 314 being sized and configured to support a container disposed therein. Particularly, the longitudinal upper end 315 of each of sections 314 may contact the rolled rim of a container to provide support thereto. Such a configuration may be advantageous as using less material than a solid sleeve structure and may also allow for less precise tolerances between a container and the sleeve structure 310, since the sections 314 may be more radially flexible as compared to a solid sleeve structure.

Of course, the sections 314 and, correspondingly, cuts 312 may comprise other geometries. For instance, cuts 312 may be configured as substantially longitudinal slits that separate sections having constant circumferential cross sections. Also, alternatively, for instance, relatively few sections 314 may be required. Accordingly, circumferential spaces may separate sections 314 and the number of sections 314 may be accordingly reduced, the circumferential lengths of the sections 314 may be reduced, or the sections 314 may be otherwise configured. Furthermore, sections 314 may be configured to interlock with structures of a container to affix or position the sleeve structure 310 in relation to a container.

Figure 7B:
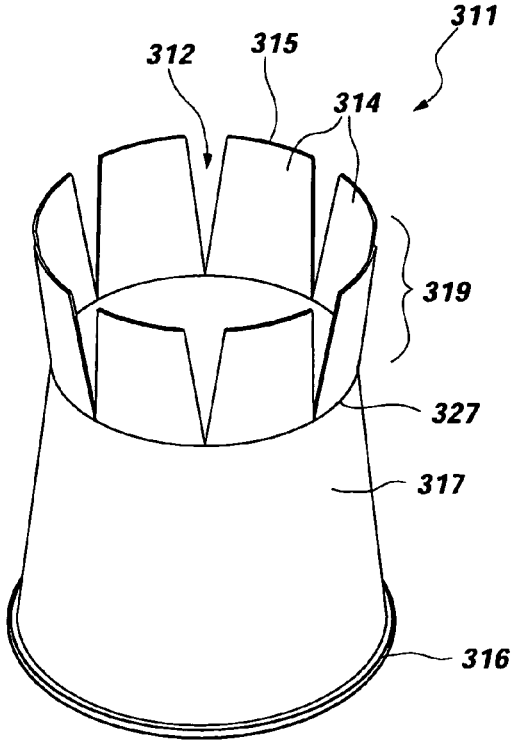
FIG. 7B shows a perspective view of another exemplary sleeve structure of the present invention including circumferentially separated sections configured to bend radially outwardly.

Alternatively, as shown in FIG. 7B, illustrating sleeve structure 311 in a side perspective view, the sections 314 may be configured to bend radially outwardly, generally within region 319. Thus, sleeve structure 311 may comprise a first radially inwardly tapered region 317 extending from the rolled rim 316 longitudinally upwardly and a radially outwardly tapered region 319 extending from the upper longitudinal extent of region 317 longitudinally upwardly. Such a configuration may improve the ability of a user of a container and sleeve structure 311 to hold and handle the assembly thereof. Further, such a configuration may allow for region 317 (as well as region 319, prior to bending of sections 314) of sleeve structure 311 to be formed with a greater magnitude of taper or draft, which may allow for greater stacking density when one sleeve structure 311 is disposed in a stacking fashion with another sleeve structure 311. As an additional advantage, the upper ends 315 of sections 314 need not contact the rolled rim of a container to provide support thereto. Rather, the relationship and engagement between the complementary tapered shapes of a container wall and region 319 as well as waist 327 between regions 317 and 319 may lock or conformably fit against one another to position and hold the container within the sleeve structure.

Figure 7C:
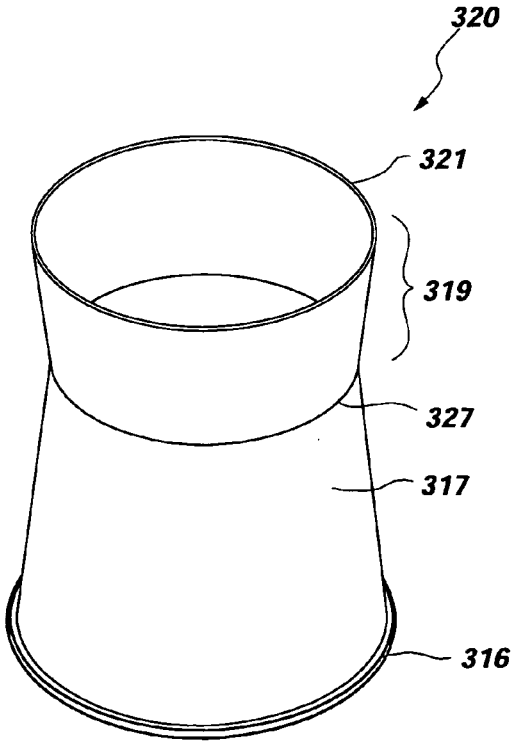
FIG. 7C shows a perspective view of a further exemplary sleeve structure of the present invention configured as two frustoconical regions having generally opposing tapers.

As yet another alternative, a sleeve structure of the present invention may include one or more frustoconical regions, with generally complementary tapers or opposing tapers. Specifically, as shown in FIG. 7C, a sleeve structure 320 may be formed with a first frustoconical, inwardly radially tapered region 317, in relation to an upward longitudinal direction, and a second frustoconical, outwardly radially tapered region 319, in relation to an upward longitudinal direction, regions 317 and 319 joined at waist 327. Outwardly radially tapered region 319 may exhibit a degree of taper that is substantially identical to a side wall of a container configured to be disposed therein. Such a configuration may allow for a container disposed within sleeve structure 320 to fit therein without engaging the upper edge 321 of region 319. As shown in FIG. 7C, region 317 and region 319 may be both frustoconically shaped and may exhibit generally opposing tapers. Configuring a sleeve structure of the present invention with two or more frustoconical regions may be advantageous in allowing greater flexibility in design as well as improving the ability of a user to hold and handle such a sleeve structure, when assembled with a container.

Figure 7D:
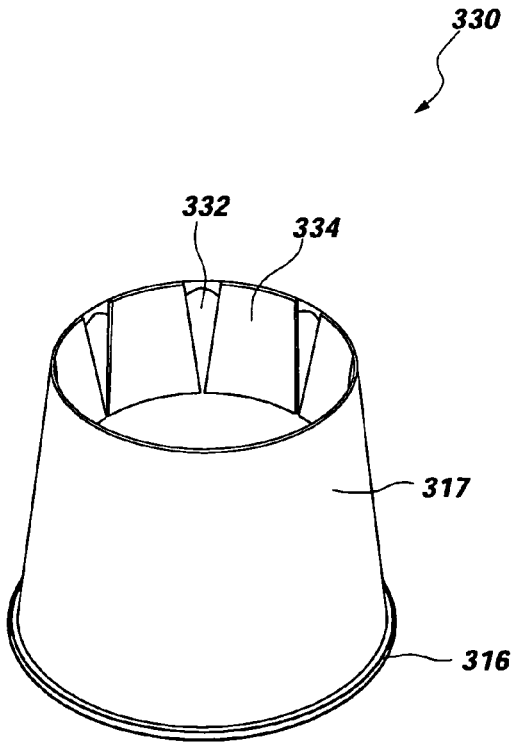
FIG. 7D shows a perspective view of yet another exemplary sleeve structure of the present invention including circumferentially separated sections folded into the interior of a frustoconical region of the sleeve structure.
Figure 7E:
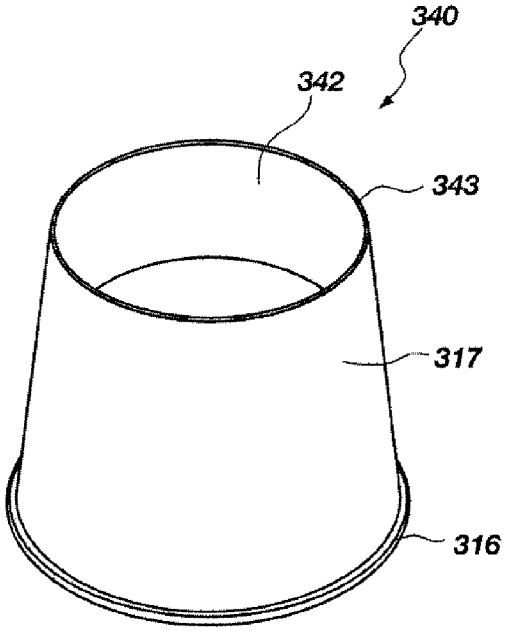
FIG. 7E shows a perspective view of yet a further exemplary sleeve structure of the present invention including a frustoconical region disposed within another frustoconical region thereof.

In a further embodiment of a sleeve structure of the present invention, circumferentially separated sections of the sleeve structure may be folded radially inwardly and within a lower region of the sleeve to form a radially outwardly tapered geometry with respect to a longitudinally upward direction. More particularly, as shown in FIG. 7D, circumferential adjacent sections 334 may be formed and separated by triangular cuts 332 between each of sections 334, wherein sections 334 may be folded into the interior of region 317 of sleeve structure 330. Alternatively, a sleeve structure of the present invention may be formed by two frustoconical geometries having generally opposing tapers, wherein one of the frustoconical geometries is disposed within the other frustoconical geometry. Turning to FIG. 7E, region 317 of sleeve structure 340 forms a frustoconical geometry, while region 342 forms another frustoconical geometry. Region 317 exhibits inwardly radial tapering with respect to an upward longitudinal direction, while region 342 exhibits outwardly radial tapering in relation to an upward longitudinal direction. Also, region 317 meets and is connected to region 342 at upper longitudinal edge 343. Of course, region 342 may be configured to at least partially conformably receive or engage a portion of a side wall of a container disposed therein.

Figure 7F:
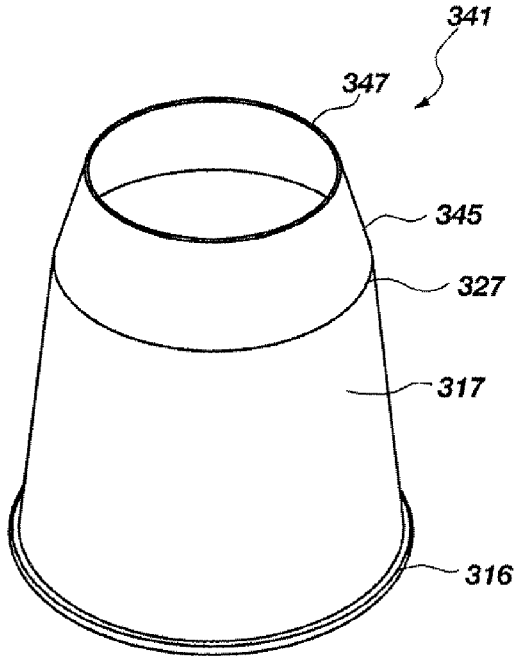
FIG. 7F shows a perspective view of a further exemplary sleeve structure of the present invention configured as two frustoconical regions having generally complementary tapers.

Alternatively, upon appropriate sizing, two frustoconical regions of a sleeve structure of the present invention may exhibit complementary tapers. Specifically, as shown in FIG. 7F, a sleeve structure 341 may be formed with a first frustoconical, inwardly radially tapered region 317, in relation to an upward longitudinal direction, and a second frustoconical, inwardly radially tapered region 345, in relation to an upward longitudinal direction, regions 317 and 345 joined at waist 327. At least one of inwardly radially tapered regions 345 and 317 may exhibit a degree of taper that is greater than a side wall of a container configured to be disposed therein. Such a configuration may allow for a container disposed within sleeve structure 341 to fit therein without engaging the upper edge 347 of region 345. Further, optionally, a sleeve structure of the present invention may include at least one generally cylindrical region (i.e., without taper), without limitation.

Figure 7G:
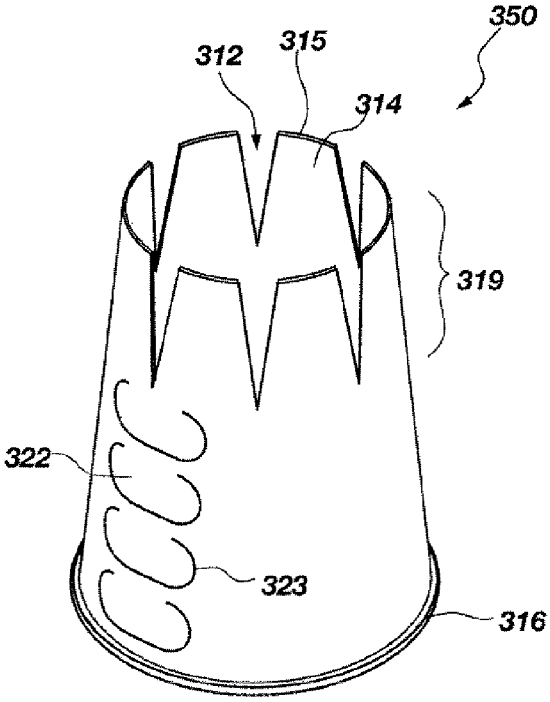
FIG. 7G shows a perspective view of another exemplary sleeve structure of the present invention including tabs formed therein.

In a further aspect of the present invention, FIG. 7G shows a sleeve structure 350, in a side perspective view, which may be generally configured according to the embodiment shown in FIG. 7A, including a generally annular body, which tapers radially inwardly as it extends longitudinally upward from rolled rim 316, and a plurality of circumferentially adjacent, longitudinally extending sections 314, separated circumferentially by cuts 312, formed in an upper region 319. However, sleeve structure 350 also includes perforations 323 forming tabs 322, which may be configured to be bent outwardly from sleeve structure 350. Of course, tabs 322 may, alternatively, be bent inwardly, subject to the position of a container disposed within sleeve structure 350. Either bending tabs 322 inwardly or outwardly may provide enhanced gripping for a user of such a sleeve structure 350 when assembled with a container. Particularly, perforations 323 forming tabs 322 may be sized according to an expected size of fingers of a user of the sleeve structure 350. Of course, tabs 322 may be configured to be completely removed from sleeve structure 350 to provide improved handing characteristics thereto.

The present invention contemplates that any of the sleeves, sleeve structures, containers, and lids described herein may be assembled, upon appropriate sizing, to fit with one another. Therefore, one or more containers, each including a sleeve structure, may be stacked in a longitudinal relationship wherein any container which is longitudinally below another container includes a lid which comprises at least one stabilizing feature, the stabilizing feature sized and configured to engage the sleeve structure associated with the container disposed longitudinally thereabove.

Figure 8A:
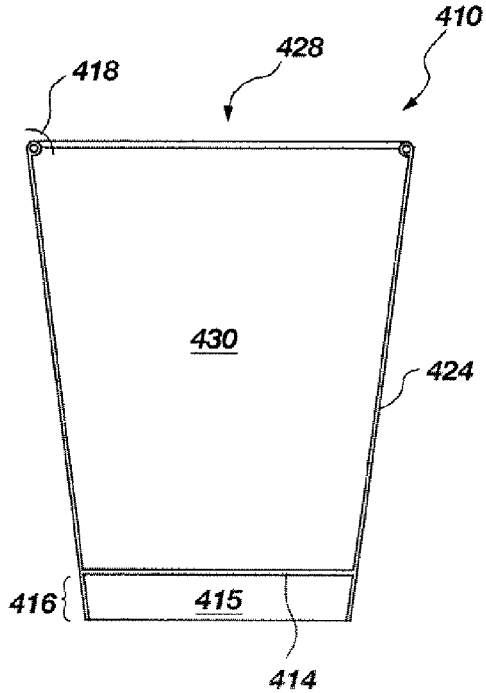
FIG. 8A shows a side cross-sectional view of another exemplary container of the present invention.

It should be understood that there are many alternatives to the containers, sleeve structures, and lids described above that do not depart from the present invention. For example, FIG. 8A shows a side cross-sectional view of another container 410 of the present invention, wherein rolled rim 418 is oriented radially inwardly. Rolled rim 418 defining opening 428 may stiffen or resist bending or deformation of container 410 during use. Container 410 may generally exhibit radial symmetry about a longitudinal or central axis (not shown), about which side wall 424 may be positioned and circumferentially extend about. Radially inwardly extending lower wall 414 may be positioned longitudinally along the inner surface of side wall 424, the combination of lower wall 414 and side wall 424 forming interior 430 of container 410. Container 410 may also include end recess 415 bounded by lower wall 414 as well as the stub portion 416 of side wall 424 that extends downwardly therepast.

Figure 8B:
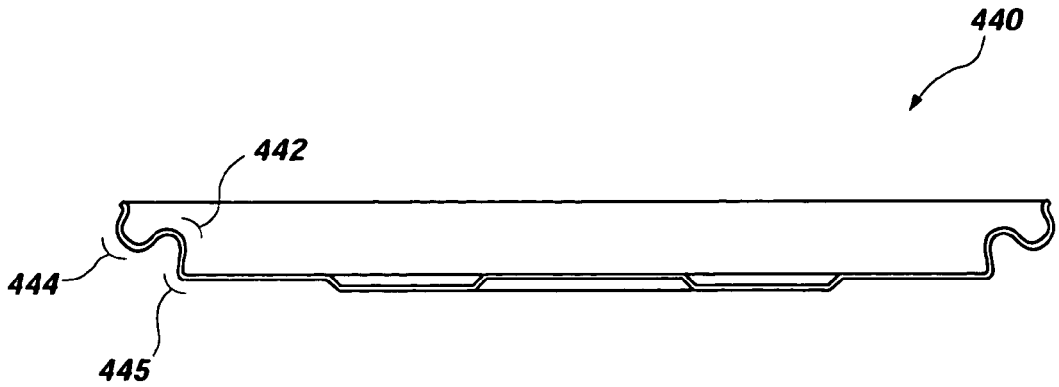
FIG. 8B shows a cross-sectional view of another exemplary lid according to the present invention.

FIG. 8B shows a side cross-sectional view of a lid 440 of the present invention, comprising a generally radially extending body forming a downwardly oriented arcuate recess 442 and an upwardly oriented arcuate recess 444. Lid 440 is sized and configured to be disposed into opening 428 of container 410, so that one of downwardly oriented arcuate recess 442 and radial protrusion 445 engages at least a portion of rolled rim 418 to position, bias, or position and bias lid 440 in relation to container 410.

Figure 8C:
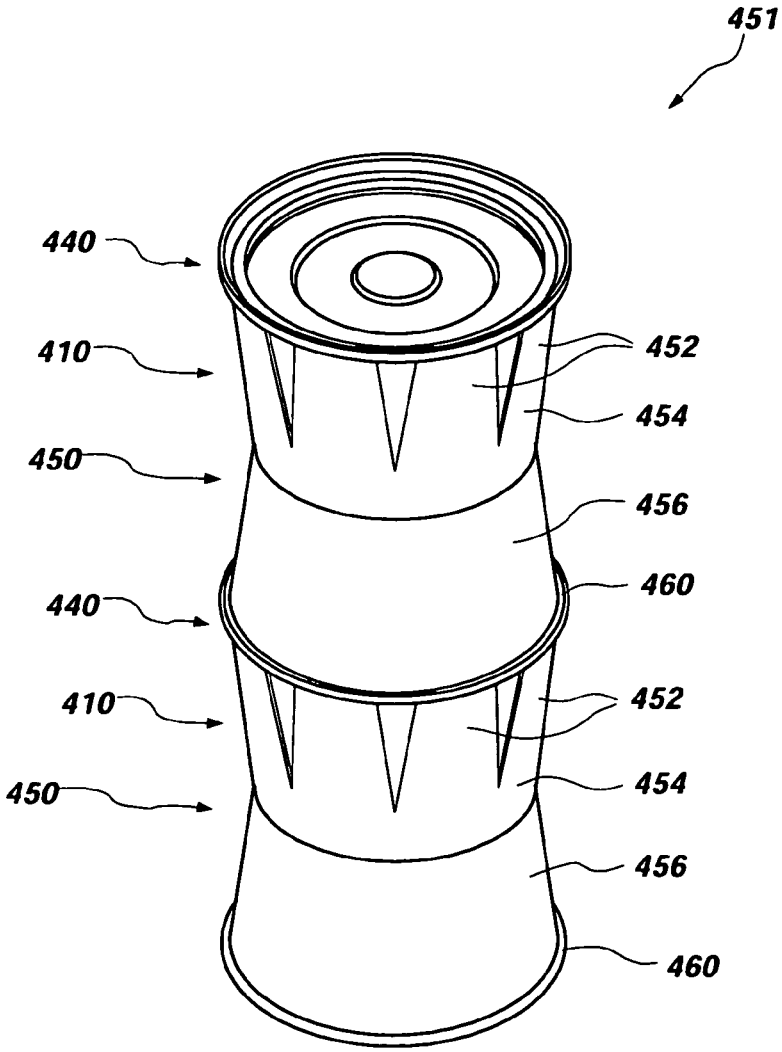
FIG. 8C shows a side perspective view of an assembly of two containers as shown in FIG. 8A, two lids as shown in FIG. 8B, and two sleeve structures of the present invention.

Further, FIG. 8C shows a perspective view of an assembly 451 of two containers 410, each container 410 having an associated lid 440, and each container 410 also including a sleeve structure 450 disposed thereabout. Sleeve structures 450 each include a radially inwardly tapered region 456 as well as a radially outwardly tapered region 454, as well as a plurality of circumferentially separated sections 452. Further, each of sleeve structures 450 may include a lower rolled rim 460.

Figure 8D:
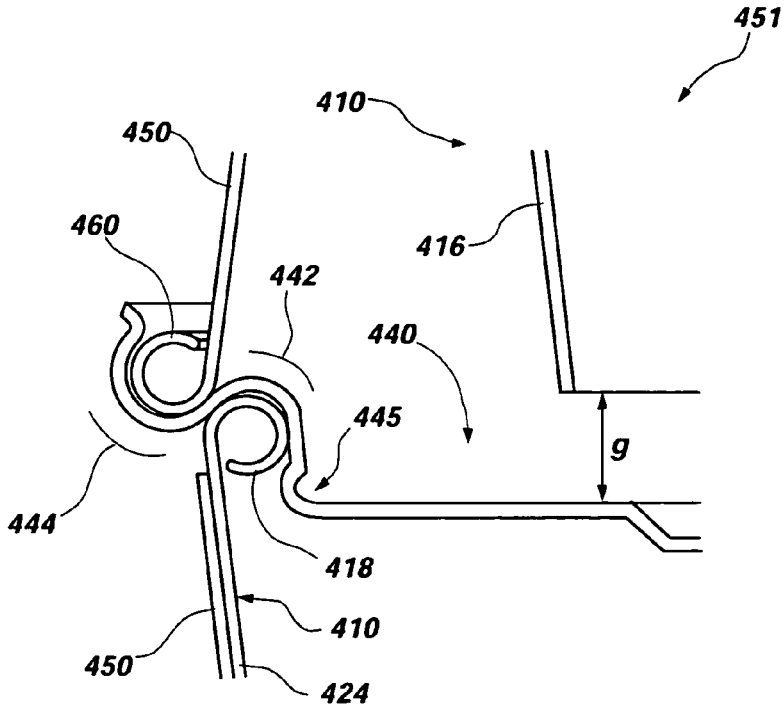
FIG. 8D shows an enlarged partial side cross-sectional view of the assembly shown in FIG. 8C.

Turning to FIG. 8D, an enlarged partial cross-sectional view of the assembly 451 shown in FIG. 8C is shown, depicting the position and engagement of containers 410, sleeve structures 450, and lid 440. Explaining further, lid 440 may be positioned onto lower container 410, wherein downwardly oriented arcuate recess 442 substantially conformably engages at least a portion of rolled rim 418. Further, radial protrusion 445 may be sized and configured to inhibit the lid 440 and container 410 moving in longitudinally opposite directions. A portion of lower sleeve structure 450 is shown as extending longitudinally upward, substantially parallel to side wall 424 of lower container 410. A portion of upper sleeve structure 450 associated with upper container 410 is shown extending longitudinally downward, forming rolled rim 460, which is positioned in engagement with upwardly oriented arcuate recess 444. As may also be seen with reference to FIG. 8D, gap "g" between the lower extent of the stub portion 416 of upper container 410 and lid 440 may be advantageous in allowing the tolerances of the container 410, lid 440, or both of the tolerances of the lid 440 and container 410 to vary more than if the container 410 were to engage the lid 440. However, if suitable accuracy exists, the lower extent of container 410 may be configured to contact the lid 440, without limitation.

In yet another aspect of the present invention, while lids have been described hereinabove as including stabilizing features, a sleeve structure of the present invention, associated with a first container, may include one or more stabilizing features, wherein the one or more stabilizing features are configured to engage another sleeve structure associated with and assembled to another container disposed longitudinally thereabove in a stacked relationship.

Figure 9A:
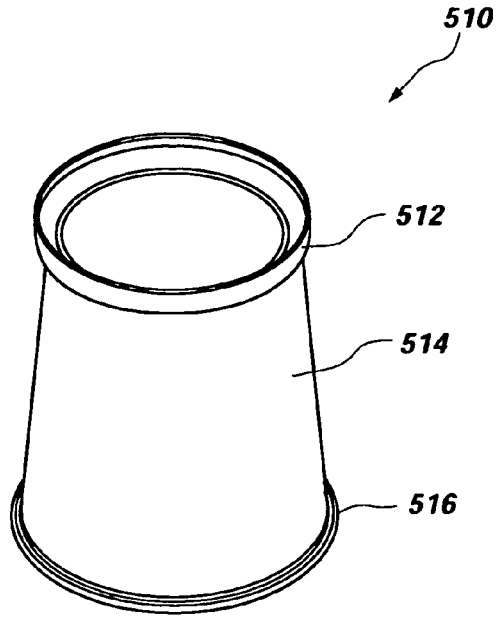
FIG. 9A shows a perspective view of a sleeve structure of the present invention including a stabilizing feature.
Figure 9B:
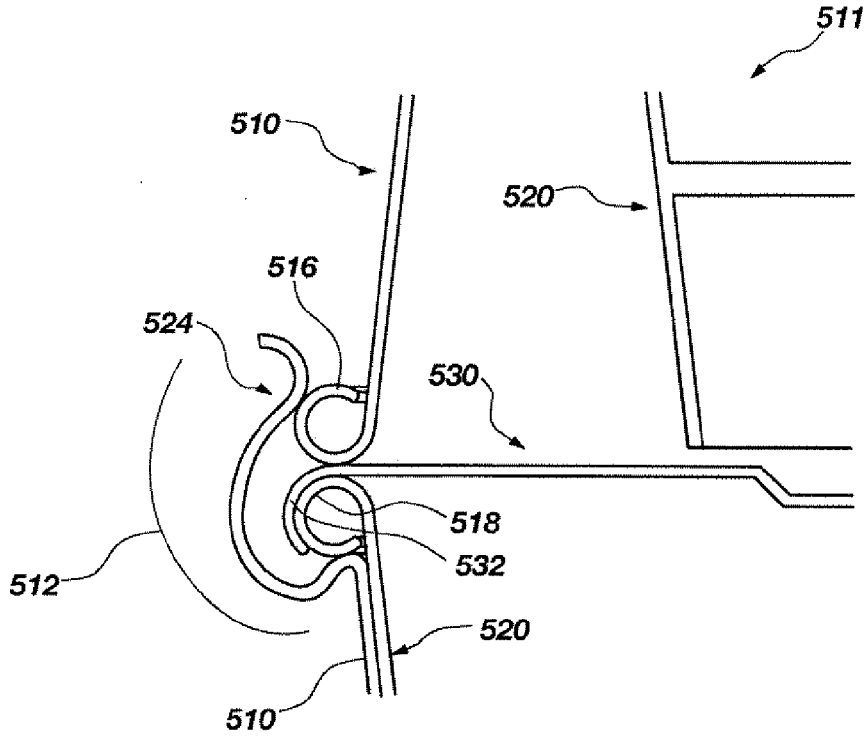
FIG. 9B shows an enlarged partial cross-sectional view of an exemplary assembly of two containers, a lid, and two sleeve structures, as shown in FIG. 9A.

Particularly, as shown in FIG. 9A, which illustrates sleeve structure 510 in a perspective view, sleeve structure 510 comprises a frustoconical region 514 having a rolled rim 516 at the lower longitudinal end thereof, as well as a stabilizing feature 512 at the upper longitudinal end thereof. FIG. 9B shows an enlarged partial side cross-sectional view of an assembly 511 including two containers 520 arranged in a stacked relationship, a lid 530 disposed on the lower container 520, and sleeve structures 510 associated with and assembled to each of containers 520. FIG. 9B shows lid 530, including arcuate lip 532 which may be sized and configured to engage against rolled rim 518 of lower container 520. As may be seen, stabilizing feature 512 may be sized and configured, as assembled to lower container 520 and in combination with lid 530 disposed onto lower container 520, to engage at least a portion of rolled rim 516 of upper sleeve structure 510 by way of radial protrusion 524. It should be understood that, although the foregoing embodiments show stabilizing features that engage at least a portion of a rolled rim of a sleeve structure, a rolled rim is not necessary to practice the present invention. Rather, a stabilizing feature of the present invention may engage a portion of any part of a sleeve structure so as to provide stability thereto, without limitation.

Figure 10A:
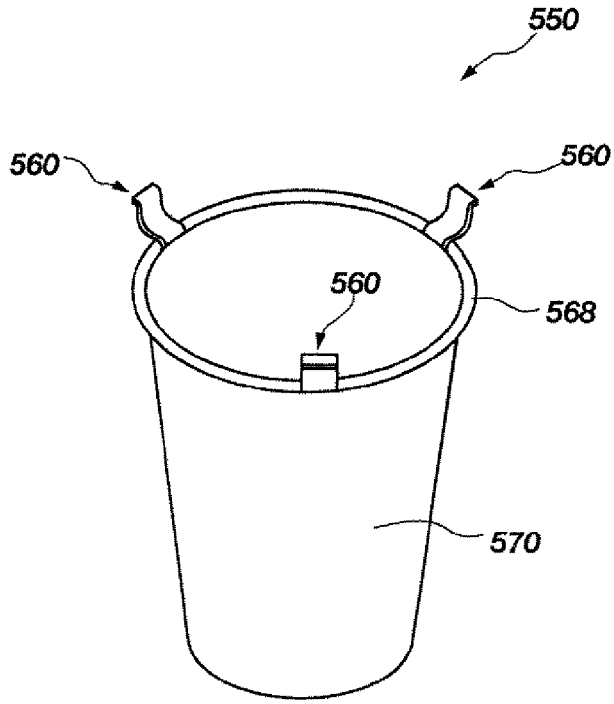
FIG. 10A shows a perspective view of a container of the present invention including three stabilizing features.
Figure 10B:
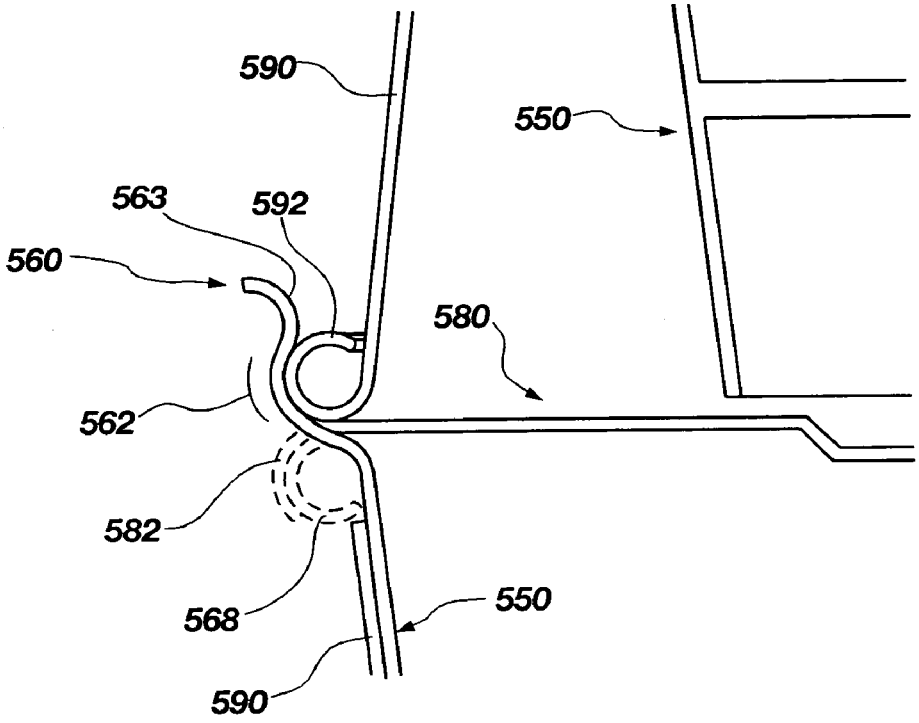
FIG. 10B shows an enlarged partial cross-sectional view of an exemplary assembly of two sleeve structures, a lid, and two containers as shown in FIG. 10A.

As a further facet of the present invention, a container of the present invention may be configured with a stabilizing feature. As shown in FIG. 10A, container 550, which may be configured according to container 110 described hereinabove, includes radially outwardly tapered portion 570, rolled rim 568, and three stabilizing features 560 disposed circumferentially along rolled rim 568. FIG. 10B shows an enlarge partial side cross-sectional view of an assembly of two containers 550 arranged in a stacked relationship, associated sleeve structures 590, and lid 580, where the cross-sectional view is taken through one of stabilizing features 560. As may be seen, stabilizing feature 560 may include arcuate wall 562, and inwardly oriented radial protrusion 563, which may be sized and configured, upon being assembled to lower container 550 and in combination with lid 580 disposed onto lower container 550, to engage at least a portion of rolled rim 592 of upper sleeve structure 590. Of course, lid 580 may include circumferential gaps or recesses to accommodate stabilizing features 560. However, arcuate lip 582 as well as rolled rim 568 of lower container 550 are both depicted in FIG. 10B, for completeness.

Figure 12:
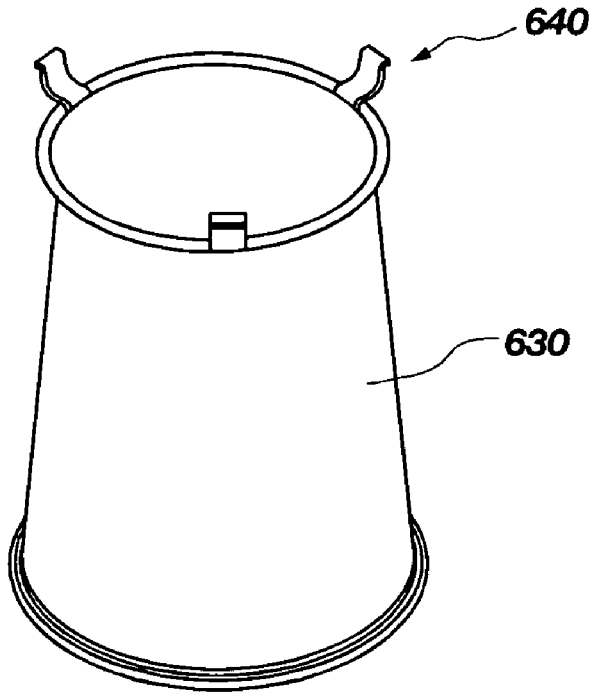
FIG. 12 shows a perspective view of another embodiment of a sleeve structure of the present invention.

Generally, any of the stabilizing features described herein may be fabricated separately from a lid, container, or sleeve structure of the present invention and may be configured to be selectively assembled, removed, or both assembled to and removed from a respective lid, container, or sleeve structure, without limitation. Such a configuration may allow for greater flexibility in design and use of lids, containers, sleeve structures and assemblies thereof. For example, as shown in FIG. 12, a sleeve 630 may have circumferentially separated stabilizing features 640, as shown with respect to a container in FIG. 10A. The stabilizing features 640 may each be upwardly oriented arcuate recesses sized and configured to engage at least a portion of a rolled rim of another sleeve structure, such as the lid 440 shown in FIG. 8B.

Figure 11:
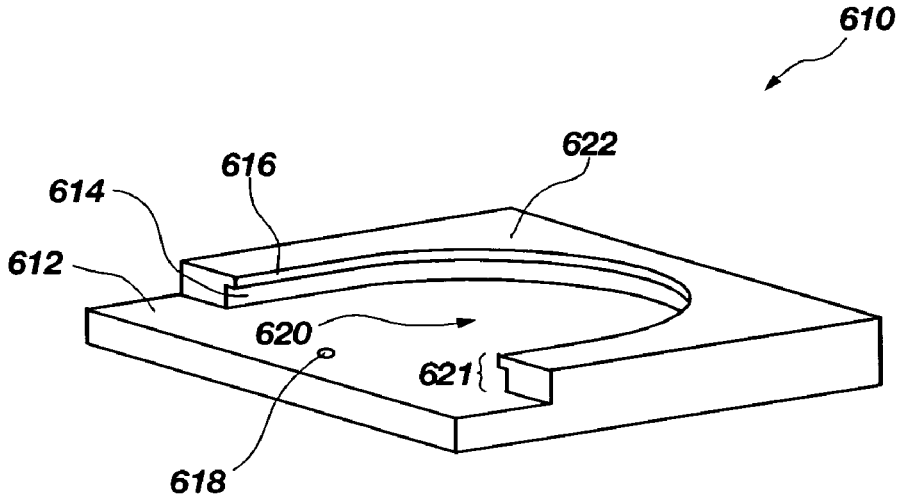
FIG. 11 shows a perspective view of an exemplary holding structure for an assembly of a container and sleeve structure of the present invention.

In a further aspect of the present invention, a holding structure may be configured to engage an assembly of a container and sleeve structure of the present invention. Specifically, as shown in FIG. 11, holding structure 610 may comprise a base 612 having a raised portion 622 in which a semi-circular or generally U-shaped recess 620 is formed. Recess 620 may be generally defined by a side wall 621 including lower groove 614 and an overhanging lip 616. Lower groove 614 may be sized to accommodate a rolled rim of a sleeve structure of the present invention, as in any of the embodiments described hereinabove. As may be appreciated, lower groove 614 in combination with overhanging lip 616 may be sized and configured to preferentially retain a sleeve structure disposed therein. In addition, button 618 may be sized and configured to retain a sleeve structure disposed within recess 620. Particularly, button 618 may be biasable or resilient, for instance, spring-loaded or otherwise movable to position or bias a sleeve structure disposed within recess 620.

However, the present invention is not limited to a holding apparatus or structure sized to fit a portion of a sleeve structure within a recess thereof. Rather, a holding apparatus of the present invention may fit into the space or gap formed between a container and a sleeve structure of the present invention. Summarizing, a holding apparatus or structure of the present invention may be configured to engage at least a portion of a sleeve structure, to position or bias the same. Furthermore, a holding apparatus or structure may comprise a tray, a vehicle container holder, a cardboard food and beverage holder, or an adapter for converting an existing, different holding apparatus to a holding apparatus of the present invention, without limitation.

Although specific embodiments have been shown by way of example in the drawings and have been described in detail herein, the invention may be susceptible to various modifications, combinations, and alternative forms. Therefore, it should be understood that the invention is not intended to be limited to the particular forms disclosed. Rather, the invention includes all modifications, equivalents, combinations, and alternatives falling within the spirit and scope of the invention as defined by the following appended claims.

What is claimed is:

1. A lid comprising:

a radially extending body;

wherein the lid is sized and configured to engage at least a portion of a container having a selected size and shape to substantially close an opening thereof;

at least one stabilizing feature positioned to lie radially beyond the opening of the container, and sized and configured to engage at least a portion of a sleeve structure having a selected size and shape which is associated and assembled concentrically with another container having a selected size and shape, upon the another container being positioned generally longitudinally above the lid.

2. The lid of claim 1, wherein the lid is configured to engage at least a portion of a rolled rim of the container formed on an upper longitudinal end thereof and defining the opening thereof.

3. The lid of claim 2, further comprising at least one aperture in the radially extending body sized and configured to allow liquid to pass therethrough.

4. The lid of claim 2, wherein the lid comprises a downwardly oriented arcuate recess for engaging at least a portion of the rolled rim of the container.

5. The lid of claim 2, wherein the at least one stabilizing feature is positioned to lie generally proximate to the rolled rim of the container.

6. The lid of claim 1, wherein the at least one stabilizing feature is sized and configured to engage at least a portion of a rolled rim formed on a lower longitudinal end of the sleeve structure.

7. The lid of claim 6, wherein the at least one stabilizing feature comprises an inwardly oriented radial protrusion.

8. The lid of claim 6, wherein the at least one stabilizing feature comprises an upwardly oriented arcuate recess.

9. The lid of claim 6, wherein the at least one stabilizing feature comprises an upwardly oriented arcuate recess sized and configured to conformably engage at least a portion of the rolled rim of the sleeve structure.

10. The lid of claim 1, wherein the at least one stabilizing feature is integrally formed with the lid.

11. The lid of claim 1, wherein the at least one stabilizing feature is configured to be removed from the lid.

12. The lid of claim 1, wherein the at least one stabilizing feature comprises two or more circumferentially separated stabilizing features.

13. The lid of claim 12, wherein:

the two or more stabilizing features each comprise an upwardly oriented arcuate recess; and each upwardly oriented arcuate recess is sized and configured to engage at least a portion of a rolled rim formed on a lower longitudinal end of the sleeve structure.

14. A container, comprising:

a lower wall;

a side wall extending from the lower wall and forming an opening; and two or more circumferentially separated stabilizing features, each stabilizing feature comprising an inwardly oriented radial protrusion sized and configured to engage at least a portion of a sleeve structure associated and assembled with another container positioned longitudinally above the container.

15. The container of claim 14, wherein:

each circumferentially separated stabilizing feature is sized and configured to engage at least a portion of a rolled rim formed on a lower longitudinal end of the sleeve structure.

16. The container of claim 14, wherein each circumferentially separated stabilizing feature is positioned to lie radially beyond the opening of the container.

17. The container of claim 14, wherein:

the container further comprises a rolled rim formed on an upper longitudinal end thereof; and each circumferentially separated stabilizing feature is positioned to lie generally proximate to the rolled rim of the container.

18. The container of claim 14, wherein:

each circumferentially separated stabilizing feature is sized and configured to engage at least a portion of a rolled rim formed on a lower longitudinal end of the sleeve structure.

19. The container of claim 14, wherein each circumferentially separated stabilizing feature comprises an upwardly oriented arcuate recess.

20. The container of claim 19, wherein:

each circumferentially separated stabilizing feature is sized and configured to engage at least a portion of a rolled rim formed on a lower longitudinal end of the sleeve structure.

21. The container of claim 14, wherein each circumferentially separated stabilizing feature is integrally formed with the container.

22. The container of claim 14, wherein each circumferentially separated stabilizing feature is configured to be removed from the container.

23. The container of claim 14, wherein:

the two or more circumferentially separated stabilizing features each comprise an upwardly oriented arcuate recess; and each upwardly oriented arcuate recess is sized and configured to engage at least a portion of a rolled rim formed on a lower longitudinal end of the sleeve structure.

24. A sleeve structure, comprising:

a side wall sized and configured to encompass at least a portion of a container having a selected size and shape and to form a space between the at least a portion of the container assembled therewith and the side wall of the sleeve structure;

wherein the upper longitudinal end of the sleeve structure includes two or more circumferentially separated longitudinally extending sections, the two or more sections configured to engage and support the at least a portion of the container;

wherein at least a portion of the sleeve structure is sized and positioned to form a space between the at least a portion of the container which the sleeve structure is sized and configured to at least partially encompass; and wherein the two or more sections are configured to bend radially inward so that upper longitudinal ends thereof engage a rolled rim formed on an upper longitudinal end of the at least a portion of container which the sleeve structure is sized and configured to at least partially encompass.

25. The sleeve structure of claim 24, further comprising tabs formed in the side wall of the sleeve structure configured to be bendable in relation to the side wall.

26. The sleeve structure of claim 24, wherein the side wall comprises a substantially flat sheet that is constrained to assume a frustoconical shape.

27. The sleeve structure of claim 24, wherein the two or more sections are configured to bend radially inwardly and into an interior of the sleeve structure, so as to form a radially outwardly tapered region, in relation to an upward longitudinal direction, the region sized, positioned, and configured to engage and support a side wall of the at least a portion of the container which the sleeve structure is sized and configured to at least partially encompass.

28. The sleeve structure of claim 24, wherein at least a portion of the sleeve structure longitudinally below the two or more circumferentially separated sections is frustoconical.

29. A sleeve structure, comprising:

a side wall sized and configured to encompass at least a portion of a container to form a space between the at least a portion of the container assembled therewith and the side wall of the sleeve structure;

wherein the side wall comprises at least two frustoconical regions;

wherein at least a portion of the sleeve structure is sized and positioned to form a space between the side wall and the at least a portion of the container which the sleeve structure is sized and configured to at least partially encompass; and wherein at least two of the at least two frustoconical regions exhibit complementary tapers.

30. The sleeve structure of claim 29, wherein at least two of the at least two frustoconical regions exhibit opposing tapers.

31. The sleeve structure of claim 30, wherein a first frustoconical region of the at least two frustoconical regions is disposed within a second frustoconical region of the at least two frustoconical regions and exhibits a generally complementary taper with respect to the at least a portion of the container which the sleeve structure is sized and configured to at least partially encompass.

32. The sleeve structure of claim 29, further comprising at least one generally cylindrical region.

33. The sleeve structure of claim 29, wherein an upper longitudinal end of the sleeve structure includes two or more circumferentially separated longitudinally extending sections.

34. A container assembly, comprising:

a lower container comprising a side wall and a radially inwardly extending lower wall, an upper longitudinal end of the side wall forming an opening;

an upper container comprising a side wall and a radially inwardly extending lower wall, an upper longitudinal end of the side wall of the upper container forming an opening;

wherein the upper container is disposed longitudinally above and generally centered in relationship to the lower container;

a sleeve structure disposed about at least a portion of the side wall of the lower container, the sleeve structure having a lower outer radial extent that exceeds a radial extent of the lower longitudinal end of the lower container and forming a space between the sleeve structure and the lower container;

a sleeve structure disposed about at least a portion of the side wall of the upper container, the sleeve structure of the upper container having a lower outer radial extent that exceeds a radial extent of the lower longitudinal end of the upper container and forming a space between the sleeve structure of the upper container and the upper container;

a lid, positioned proximate the opening of the lower container and assembled thereto; and at least one stabilizing feature disposed on at least one of the lower container, the lid, and the sleeve structure of the lower container, the at least one stabilizing feature sized and configured to matingly engage the sleeve structure disposed about the at least a portion of the side wall of the upper container.

35. The container assembly of claim 34, wherein the at least one stabilizing feature is positioned to lie radially beyond the opening of the lower container.

36. The container assembly of claim 34, wherein:

the lower container further comprises a rolled rim formed on the upper longitudinal end thereof; and the at least one stabilizing feature is positioned to lie generally proximate to the rolled rim of the lower container.

37. The container assembly of claim 34, wherein:

the at least one stabilizing feature is sized and configured to engage at least a portion of a rolled rim formed on the lower longitudinal end of the sleeve structure disposed about the at least a portion of the side wall of the upper container.

38. The container assembly of claim 34, wherein the at least one stabilizing feature comprises an inwardly oriented radial protrusion.

39. The container assembly of claim 38, wherein the at least one stabilizing feature is sized and configured to conformably engage at least a portion of the rolled rim of the sleeve structure disposed about the at least a portion of the side wall of the upper container.

40. The container assembly of claim 34, wherein the at least one stabilizing feature comprises an upwardly oriented arcuate recess.

41. The container assembly of claim 34, wherein the at least one stabilizing feature is sized and configured to conformably engage at least a portion of a rolled rim of the sleeve structure disposed about the at least a portion of the side wall of the upper container.

42. The container assembly of claim 34, wherein the at least one stabilizing feature is integrally formed with the lower container.

43. The container assembly of claim 34, wherein the at least one stabilizing feature is integrally formed with the lid.

44. The container assembly of claim 34, wherein the at least one stabilizing feature is integrally formed with the sleeve structure disposed about the at least a portion of the side wall of the lower container.

45. The container assembly of claim 34, wherein the at least one stabilizing feature comprises two or more circumferentially separated stabilizing features.

46. The container assembly of claim 45, wherein:

the two or more stabilizing features each comprise an upwardly oriented arcuate recess; and each upwardly oriented arcuate recess is sized and configured to engage at least a portion of a rolled rim formed on a lower longitudinal end of the sleeve structure disposed about the at least a portion of the side wall of the upper container.

47. The container assembly of claim 34, wherein each of the sleeve structures comprise at least two frustoconical regions.

48. The container assembly of claim 47, wherein at least two of the at least two frustoconical regions exhibit opposing tapers.

49. The container assembly of claim 48, wherein a first frustoconical region of the at least two frustoconical regions is disposed within the second frustoconical region of the at least two frustoconical regions and exhibits a generally complementary taper with respect to the container disposed therein.

50. The container assembly of claim 47, wherein at least two of the at least two frustoconical regions exhibit complementary tapers.

51. The sleeve structure of claim 48, further comprising at least one generally cylindrical region.

52. The sleeve structure of claim 48, wherein an upper longitudinal end of each of the sleeve structures includes two or more circumferentially separated longitudinally extending sections.

53. A structure for retaining a sleeve structure disposed about at least a portion of a container so as to form a space therebetween comprising:

a base;

a raised portion extending from a portion of the base;

wherein the raised portion comprises a side wail defining a generally U-shaped recess;

a lower groove formed in the side wall of the generally U-shaped recess, forming an overhanging lip thereabove;

wherein the generally U-shaped recess, the lower groove, and the overhanging lip are each sized and configured so as to cooperatively preferentially retain a lower end of the sleeve structure disposed therein.

54. The structure of claim 53, further comprising:

a movable button, the button sized and configured to retain the sleeve structure disposed within the generally U-shaped recess.

55. The structure of claim 53, wherein the structure comprises one of a container holder, a tray, a vehicle container holder, a cardboard food and beverage holder, or an adapter.

* * * * *